US006178714B1

(12) United States Patent
Carney, Jr.

(10) Patent No.: US 6,178,714 B1
(45) Date of Patent: Jan. 30, 2001

(54) MODULAR TEMPORARY BUILDING

(76) Inventor: Robert S. Carney, Jr., 4232 Colfax Ave. South, Minneapolis, MN (US) 55409

( * ) Notice: Under 35 U.S.C. 154(b), the term of this patent shall be extended for 0 days.

(21) Appl. No.: 09/347,984

(22) Filed: Jul. 6, 1999

(51) Int. Cl.[7] ..... E04B 2/16

(52) U.S. Cl. ..... 52/564; 52/293.2; 52/223.7; 52/568

(58) Field of Search ..... 52/223.6, 223.7, 52/293.2, 295, 439, 503, 504, 564, 566, 567, 568, 592.6, 606, 607, 506.05, 565

(56) References Cited

U.S. PATENT DOCUMENTS

| | | | | |
|---|---|---|---|---|
| 932,261 | * | 8/1909 | Flynn | 52/564 X |
| 1,707,858 | * | 4/1929 | Hurlbert | 52/293.2 |
| 1,753,451 | * | 4/1930 | Tonnelier | 52/564 |
| 2,019,133 | * | 10/1935 | Hincke | 52/293.2 |
| 2,141,397 | * | 12/1938 | Locke | 52/564 X |
| 2,212,184 | * | 8/1940 | Powell | 52/564 X |
| 3,780,484 | * | 12/1973 | Muse | 52/568 X |
| 4,091,585 | * | 5/1978 | Rubichank | 52/564 X |
| 4,297,816 | * | 11/1981 | Kella et al. | 52/293.2 X |
| 5,007,218 | * | 4/1981 | Bengtson et al. | 52/293.2 X |
| 6,098,357 | * | 8/2000 | Franklin et al. | 52/293.2 X |

FOREIGN PATENT DOCUMENTS

| | | | | |
|---|---|---|---|---|
| 132346 | * | 4/1949 | (AU) | 52/564 |
| 2091777 | * | 8/1982 | (GB) | 52/564 |

* cited by examiner

*Primary Examiner*—Richard Chilcot
(74) *Attorney, Agent, or Firm*—Dorsey & Whitney LLP

(57) ABSTRACT

A building system for the basic structure of a one-story, modular, temporary building, constructed primarily of fire-resistant materials, comprising: a foundation of poured, leveled concrete, having regularly spaced holes for vertical block assembly rods and/or columns; a plurality of wall blocks of standardized size(s) each block having one or more vertical block assembly holes running entirely through the said blocks; a plurality of block assembly rods and/or block assembly columns such that when a column of one or more wall blocks is placed on the foundation with the foundation and block holes aligned one or more block assembly rods and/or columns can be run through the block column and into the foundation thereby rendering an assembly of block(s), rod(s) and foundation that does not require mortar and is easy to disassemble; framing comprised of sloped top plates for a first set of parallel wall sections, spanning angle irons mounted to and perpendicular to the said sloped top plates, an optional steel I-beam major spanning beam(s) parallel to the said spanning angle irons, optional minor supporting pillars, optional major supporting pillars, optional vertical roof and foundation joining elements, optional angle irons assembled around the inside perimeter of the top of the wall sections and being joined to said wall sections; and a plurality of roof modules comprised of standardized lengths of steel ribbed decking, insulating panels, and a membrane; all such that when the aforesaid elements are assembled, the building is functionally one structural unit, can serve for decades, and can be easily disassembled and the components thereof reused. The building system further comprises standardized engineering and architectural techniques and processes such as to efficiently render designs of specific buildings having a floor plan comprised of one or more rectangular sections such that each rectangular section can have a range of dimensions, thereby facilitating specific building designs that can be fitted together with existing one-story buildings of various dimensions with the result of a larger structure that is functionally one building, and is serviceable for uses such as warehousing.

24 Claims, 19 Drawing Sheets

MODULAR TEMPORARY BUILDING

BACKGROUND OF THE INVENTION

As urban growth occurs over time, a situation often arises where major arterial routes, especially freeways, become the hub of an infrastructure such that the immediately surrounding land is seen as best suited for developments such as high rise office towers, apartments, shopping centers and other commercial uses. Special zoning is often established for these "preferred development districts".

Urban planners recognize that the land use in a preferred development district is typically a mix, including many business that have been at the same location for years and that don't require the new infrastructure. Such businesses will be referred to as "land-and-one-story businesses", because their operation can typically be most economically conducted using land and one story buildings. Although at some point the business owners may realize the benefit from their land value appreciation, the overall land value appreciation in a preferred development district may actually do land-and-one-story business owners more harm than good, for the following reasons. First, it is often difficult to gain approval for improvements to property in a preferred development district. Because everything on a property will typically be leveled when a development project is undertaken, development authorities do not want to authorize nontransferable improvements because they will drive up the cost of property for developers, delaying preferred development. Second, land-and-one-story business owners are often faced with limited or no possibility of expansion at their current location, due both to the high cost of adjacent land, and due to restrictions placed on land use in preferred development districts.

If a land-and-one-story business decides to relocate, the business may find that their current property is of low overall market value, for the following reasons. First, the constraints described above will be faced by any new owner. Second, many people are reluctant to locate a business on property that may be absorbed into a large development project at any time. Third, because the properties of many land-and-one-story businesses have odd, irregular buildings, often built for a specialized purpose, often with a variety of aesthetic, code and regulatory problems, and often with a high percentage of open land, the total rental income such properties can generate is often relatively low, even if rental income per square foot for uses such as warehouse is relatively high. Because redevelopment may not occur for a decade or more, low rental value will significantly depress the market value of a land-and-one-story property.

PURPOSES OF THE INVENTION

One purpose of the building system of the present invention is to reduce the inherent conflict between urban planning authorities and land-and-one-story business owners, by comprising an integrated, modular system for building the basic structure of an inexpensive kind of temporary building that can significantly increase the rental value of land-and-one-story properties without adding significant unrecoverable costs that would delay preferred development.

A second purpose of the building system of the present invention is to comprise an integrated, modular system for building the basic structure of a building that is similar in appearance to conventional permanent concrete block and flat roof buildings, and that has fire resistance properties similar to permanent concrete buildings.

A third purpose of the building system of the present invention is to comprise an integrated, modular building system that can be built in cold climates without a significant unrecoverable investment in a deep foundation.

A fourth purpose of the building system of the present invention is to comprise an integrated, modular building system including engineering design components and architectural design components, for rendering specific buildings having a wide range of floor layout dimensions, such that a construction plan can be quickly prepared from modular elements for a specific building that will fit together with other buildings that are on a specific property, thus providing an increased square footage of rentable warehouse space.

A fifth purpose of the building system of the present invention is to comprise an integrated, modular building system for rendering specific temporary buildings such that if and when the buildings are later taken down, the same building can be erected elsewhere, or individual modules can be reused as parts of multiple other buildings of the present invention, or in other ways, so that most of the material cost of a building of the present invention is recovered if the building is taken down.

A sixth purpose of the building system of the present invention is to render buildings that, although temporary, can remain in service at a location for decades.

A seventh purpose of the building system of the present invention is to standardize a method of disassembling a building of the present invention, such that components are disassembled, staged, loaded and distributed efficiently from the disassembly site for reuse in the construction of other buildings of the present invention and/or for other uses.

SUMMARY OF THE INVENTION

The present invention comprises an integrated, modular system for designing, building, and disassembling the basic structure of an inexpensive kind of temporary building that is similar in appearance to conventional permanent concrete block and flat roof buildings, substantially fireproof, can be erected quickly, can remain in service on a site for decades, and that can then be disassembled such that most of the components can be reused at a different location in the same building, in other buildings of the present invention, or separately.

The wall components of the system of a building of the present invention are of two main block types. The first type comprises a variation of either industry standard sized 7⅝"×7⅝"×15⅝" two cavity concrete block, or similar blocks with dimensions 7⅝"×7⅝"×18". In addition to two cavities, each concrete block has one or more block assembly holes positioned such that when the blocks are stacked directly on top of one another without mortar, block assembly rods or block assembly columns, typically of steel and threaded at the top, are then run through the block assembly holes and into the foundation to form an assembly of stacked concrete blocks. The threaded sections at the top of the rods are used to secure roof modules. The second main type of wall block component comprises larger wall modules, typically of concrete, that can be hollow, or that can have an insulation core. These wall modules are also assembled using block assembly rods and/or block assembly columns that are free standing and that run the full height of the wall, through the inside of the wall modules and to the foundation. Such rods and/or columns can vertically support the weight of the roof independent of the wall block modules.

The wall components of the system of a building of the present invention include optional insulation panels that can be placed on either the inside or the outside of the building. These panels typically run the full height of the building, and comprise a layer of insulation board that is vapor sealed, an outer layer typically of finished veneer, and top and bottom flexible panel end sections. The bottom flexible panel end section is placed on the foundation and secured by the wall blocks that are placed subsequently. The top flexible panel end section is placed on the top of the wall blocks and is secured by the weight of the roof. The vapor sealed insulation board side interfaces with the wall blocks, and can be optionally spot glued to the wall blocks.

Wall components of the system of a building of the present invention are joined to roof components using plate modules placed at the top of the wall blocks. These plate modules include roof supporting sections of steel or a similar material, typically span multiple block sections, and have holes to insert the block assembly rods and/or block assembly columns used to assemble the wall blocks. There are two main kinds of plate modules. One has a flat top, and bears roof modules that slope very slightly down to a gutter. The other has a slight rise, to provide a slope to drain the roof.

Door, garage door, and window components of the system of a building of the present invention typically comprise a frame that is sized to fit in the exact area of an array of wall block components, a premanufactured door or window inside the frame, and a lintel sized with respect to the dimensions of wall block components and having holes for the block assembly rods and/or block assembly columns used to assemble the wall blocks.

Three alternative variations comprise the foundation component of the system of a building of the present invention. Each foundation variation typically comprises a level poured concrete base, and each is typically made using a pouring form top section having hollow tubes or solid rods spaced to accommodate the block assembly rods and/or block assembly columns that are placed to assemble the walls after the foundation has hardened.

The first foundation variation comprises pouring concrete directly into a shallow trench or form, or into a form on an existing paved surface, and then leveling.

For cold climates it is desirable to avoid the cost of building a deep foundation for a building that may soon be disassembled and moved. Accordingly, a second alternative variation of the foundation system is used that comprises insulation panels on the ground. The foundation is first constructed identically to the first variation. Ground insulation panels are then secured to the walls at ground level by flexible end panels. Wall blocks are then placed on top of the ground insulation panel end panels. Ground insulation panels can be optionally pinned or weighted to the ground. Ground insulation panels can be used with or without the use of wall insulation panels.

A conventional deep foundation, below the frost line, can be used as a third alternative type of foundation for buildings of the present invention situated in cold climates.

Framing components of the system of a building of the present invention comprise the use of the wall block assemblies including block assembly rods and/or block assembly columns, together with optional major and minor pillars as vertical supporting structure. Framing components also comprise a horizontal structure of one or more optional major beams spanning supporting walls and optionally also spanning supporting pillars, spanning angle iron sections running under the roof modules the full length between opposite walls and secured to the wall block top plates, additional wall perimeter angle irons attached to wall block top plates and running along the inside perimeter of the building, plastic coated steel cable sections secured to roof modules and to the foundation, and vertical angle iron sections secured to both spanning angle irons and to the foundation . These framing components function to join the major components of a building of the present invention into a single structure. Major pillar components of the present invention are optionally used to support major spanning beams, have a square base approximately four feet on each side, and can be pinned to an existing paved surface or to the ground using rods of steel or similar material. Minor pillar components are typically used to support roof modules half way between their span, are typically placed underneath the join between two roof modules, and are typically bolted to a spanning angle iron. Minor pillar components can also be pinned to an existing paved surface or to the ground.

Floor components of the system of a building of the present invention are typically of one of two types. Some buildings are placed on already paved surfaces, and have no floor other than the pavement. Other buildings are on unpaved ground. These buildings have modular floor slabs of molded concrete, that can be optionally pinned to the unpaved ground.

Roof module components of the system of a building of the present invention comprise rectangular assemblies typically with a short roof module end of 3' in width and with a range of lengths such as 4', 6', 12', 16', 20' and the like. These roof modules are placed side by side with adjacent roof modules. The short roof module ends are attached to the threaded rod ends of the block assembly rods and/or block assembly columns that protrude through the flat wall top plates of supporting stacked block assemblies, and/or to a major spanning beam using bolts, and/or to a spanning angle iron using bolts. Roof modules comprise a base that is typically a section of ribbed steel decking, an optional layer of platform panel such as gypsumboard, typically ½ thick", a layer of insulating material in panel form, such as polyisocyanurate foam, typically 3" thick, and a layer of rubber membrane, typically of thickness 45 m to 60 m. When the roof modules are in place, rubber membrane sections are glued into place to join adjacent modules. To complete the roof, flashing is added at the top and sloped sides, and gutters are attached to the draining sides.

Building link components of the system of a building of the present invention comprise a connection between an existing building and an adjacent building of the present invention. This typically comprises a previously described garage door opening and lintel in a wall of a building of the present invention that is joined by a short section of wall blocks and wall assembly rods, typically also by a custom roof section, and sometimes by one or more additional custom side panels, to either an existing opening of an existing building, such as a garage door, or to a wall of an existing building, where a corresponding opening is to be cut. Building link components of the system of a building of the present invention can comprise a set of standard designs, but will often include a requirement to fabricate custom components for a specific building.

The system of a building of the present invention includes both standardized engineering parameters, and standardized architectural procedures for rendering blueprints of specific buildings of the present invention that are in some cases designed to fit together with pre-existing buildings. In addition, the system of a building of the present invention can comprise a disassembly plan, that details the order in which components of a building of the present invention will be disassembled, where specific components of a building that is being disassembled are to be sent to be used in construction of other buildings of the present invention or to be used in other ways, and where and when at the disassembly site specific components will be staged and loaded onto trucks.

DETAILED DESCRIPTION OF THE INVENTION

Figure 1:
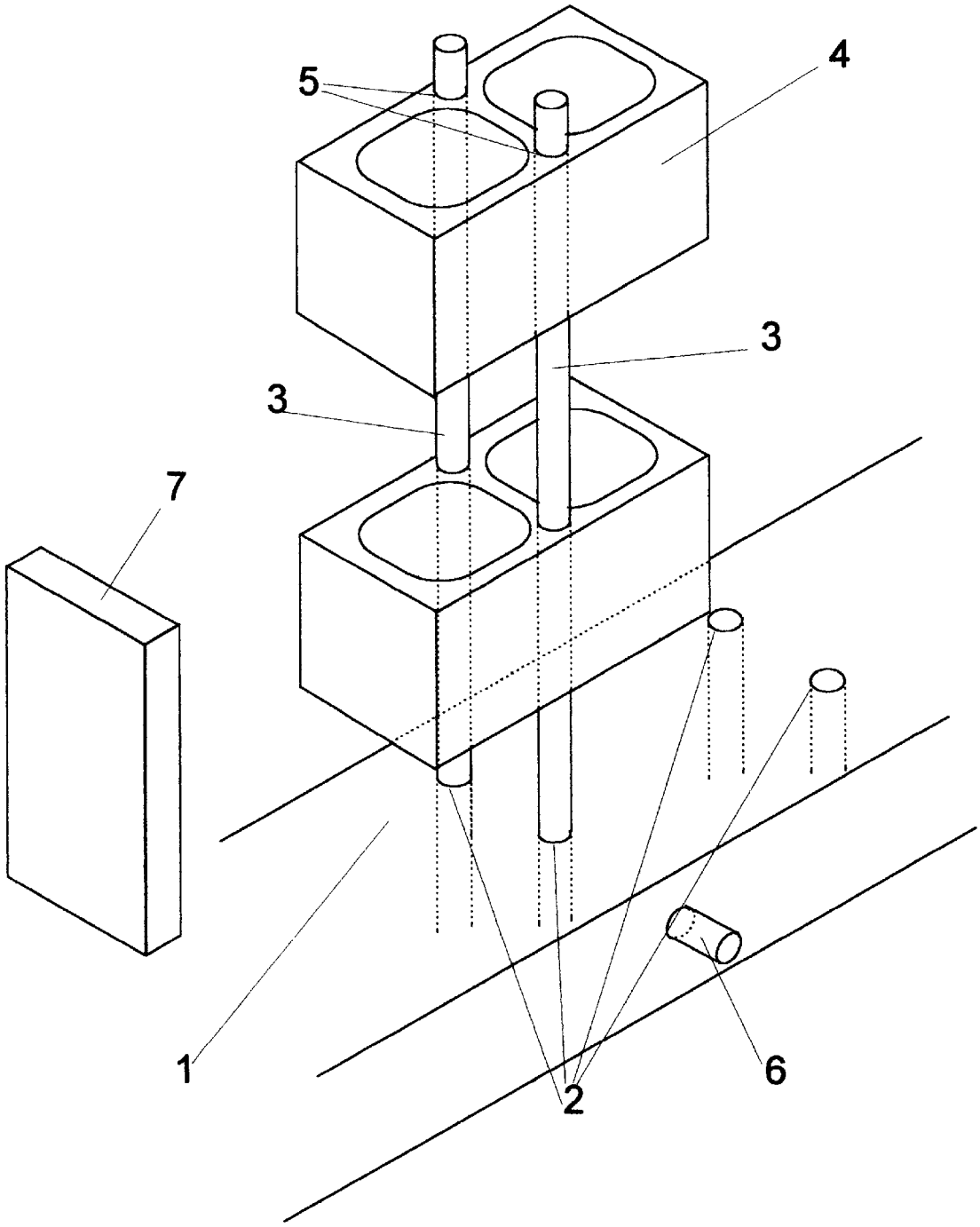
FIG. 1—Foundation, stack of concrete blocks, block assembly rods, and block joining panel section, exploded view.

FIG. 1 illustrates an exploded view of a foundation section, two cement blocks, and block assembly rods of the system of a building of the present invention. The cement blocks are typically of two sizes. One size has dimensions 7⅝"×7⅝"×15⅝", the U.S. industry standard, allowing in traditional construction for the use of mortar and a resulting final block spacing of 8" and 16" on the wall face. The use of this standard block size makes it easier to resell blocks used in a building of the present invention as standard blocks, if the building is later disassembled. The second size has dimensions 7⅝"×7⅝"×18". Because roof modules are built with ribbed steel decking having industry standards of a 3' width and 6" from rib to rib, using cement blocks 18" wide facilitates placement of a row of roof modules on a building wall of a building of the present invention.

The foundation 1 of FIG. 1 is typically of poured concrete. The foundation concrete can be poured into a shallow trench, or into forms. It can be above or below the frost line depending on the requirements for a specific building. Holes 2, spaced according to the dimensions of the concrete blocks used, are formed in the foundation 1 of FIG. 1 when the foundation is poured. The holes 2 typically go all the way through the foundation and can go into the underlying ground. If the foundation is on pre-existing pavement, holes are typically drilled in the pavement. If the foundation is on ground, drilling into the ground is typically unnecessary. When the foundation 1 is in place, and the holes 2 have been drilled to ground if needed, block assembly rods 3 are placed in the holes. These block assembly rods 3 are typically made of steel, but can be of other material, including such material as PVC. Pre-cast concrete blocks 4, having pre-formed holes 5, are placed such that the block assembly rods 3 run through the pre-formed block holes 5 in the blocks 4 of FIG. 1. In this way, a stack of pre-cast concrete blocks is assembled, that comprises a section of a wall of a building of the present invention.

As a stack of blocks is commenced, the assembly can begin with shorter block assembly rods, so that blocks are only lifted a maximum of 3' or 4' before being placed. When a stack reaches the top of the rods, one is removed and a longer rod is inserted, then the other shorter rod is removed and a longer rod is inserted. When a stack of blocks has reached full height, the final rods may optionally be sized to be driven a short distance of up to a few feet into the ground. The final block assembly rods have threaded heads that are used to bolt on roof modules.

When concrete blocks with standard dimensions 7⅝"×7⅝"×15⅝" are used, because the industry standard for ribbed steel decking used in roof modules is 3' wide with ribs spaced every 6", a liner block approximately 2⅜" thick is required, to be placed between adjacent stacks of concrete blocks. Such a liner block section is shown as 7 in FIG. 1. Liner block sections are typically 2' or 3' high. The thickness and compressibility of the liner blocks and the spacing of the foundation holes is such that when the concrete blocks are in place, the liner blocks are secured by the concrete blocks. The use of the liner blocks results in the center of each concrete block being approximately 18" from the center of adjacent blocks in adjacent stacks.

Thus, by repeating the steps for the placement of block assembly rods, pre-formed concrete blocks, and liner blocks when required, a wall is assembled that is sized for subsequent placing of roof modules.

Figure 2:
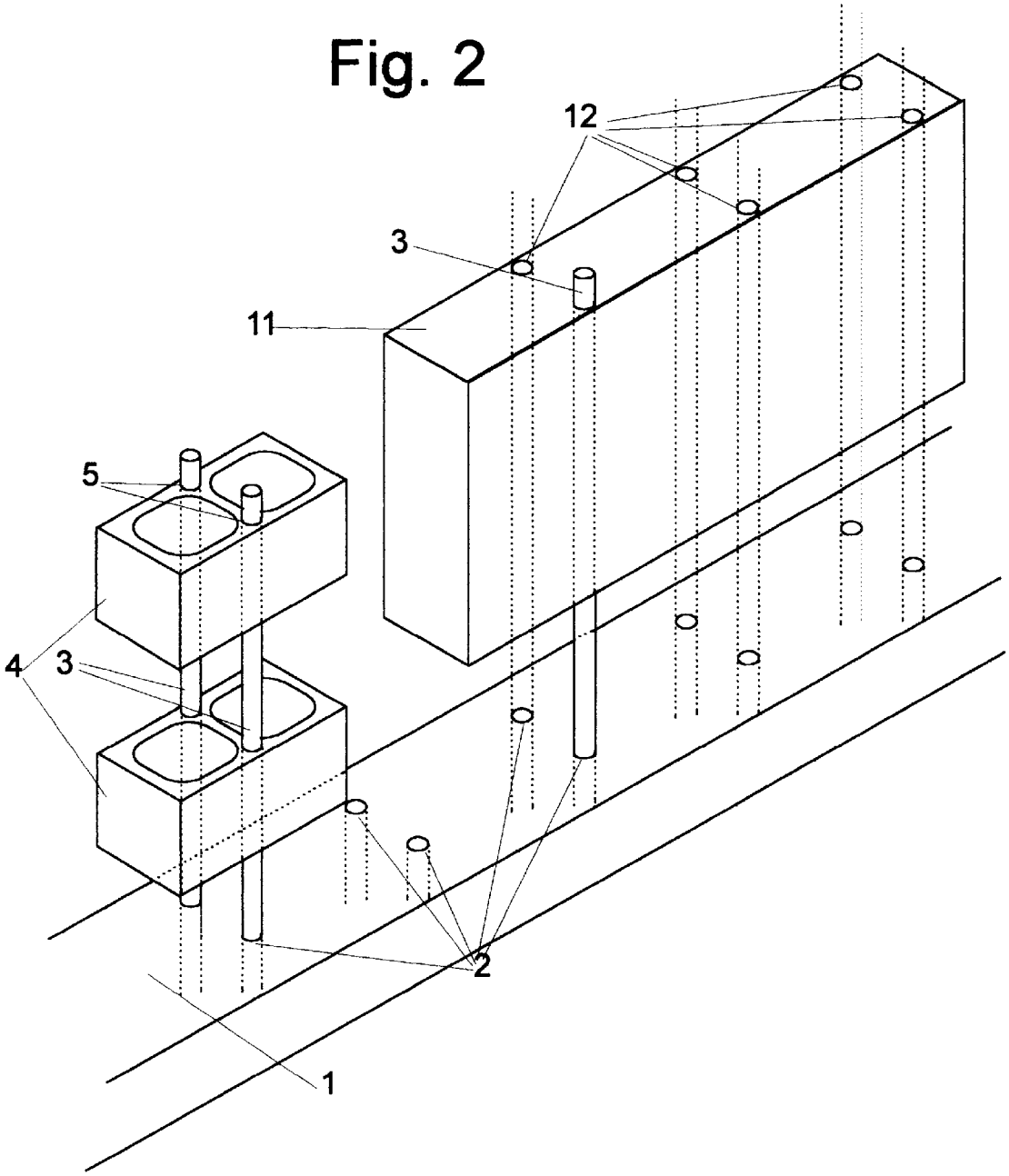
FIG. 2—Foundation, stack of concrete blocks, wall block, and block assembly rods, exploded view.

An alternative type of wall of the system of a building of the present invention is comprised of larger wall block sections, such as the section 11 illustrated in FIG. 2. These larger wall block sections 11 can be of pre-cast solid concrete, or of hollow core concrete, or of concrete with a lightweight core such as of insulating material, or of other material. As with the concrete blocks, the larger wall block sections 11 are placed such that the block assembly rods 3 of FIG. 2 run through the pre-formed wall block holes 12 in the wall blocks 11 of FIG. 2. The design of larger wall blocks is such that the block dimensions and/or the number and spacing of the wall block holes 12 are determined with respect to the 3' width and 6" rib spacing of roof modules. The use of larger wall block sections permits designs of wall block sections with lower density, and improved insulating properties that may in some cases make additional insulation unnecessary.

Figure 3:
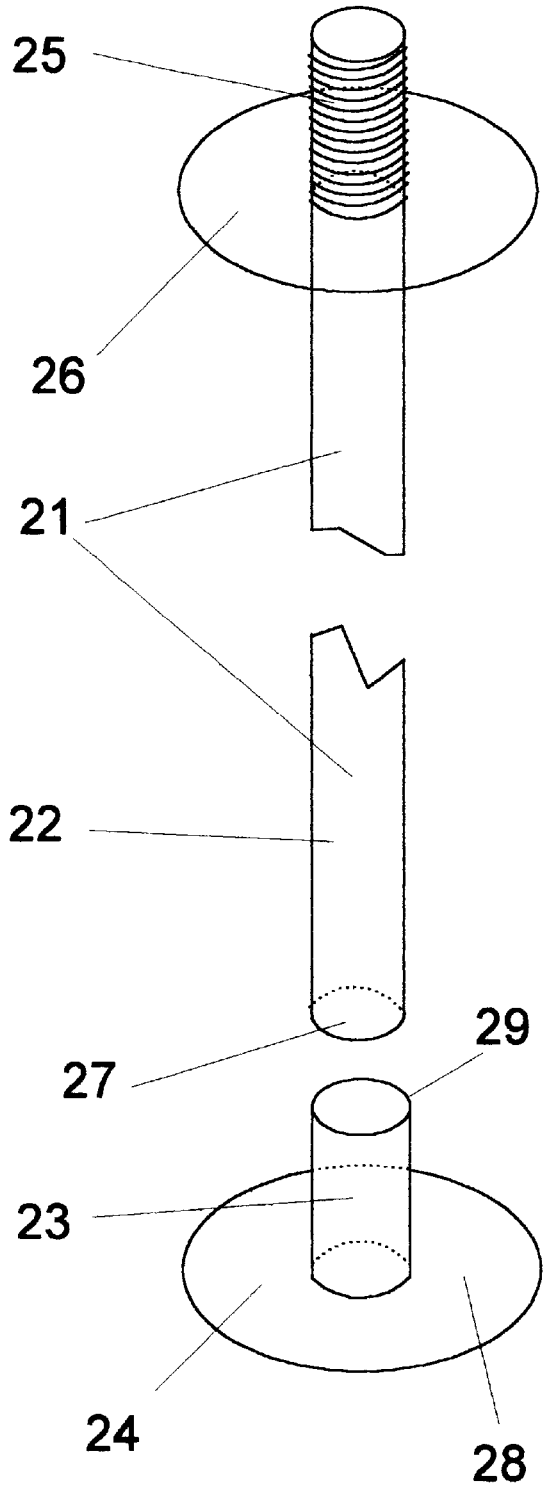
FIG. 3—Enhanced block assembly rod and base, exploded view.

FIG. 3 illustrates a second alternative and enhanced kind of structure for the use of block assembly rods in the system of a building of the present invention. This enhanced block assembly rod, shown as 21 in FIG. 3, is typically of steel, and comprises a rod shaft 22 having a flat bottom 27, a top rod plate 26 that is typically of steel and is typically welded to the rod shaft 22, and a threaded top section 25. The enhanced block assembly rod 21 is used with a block assembly rod base 28, typically of steel, comprising a hollow tube structure 23 that is typically welded to a base plate 24. When the building foundation is formed, block assembly rod bases 28 are cast in the concrete, with the open hole of the tube structure top 29 of FIG. 3 typically even or slightly below the level foundation top.

Figure 4:
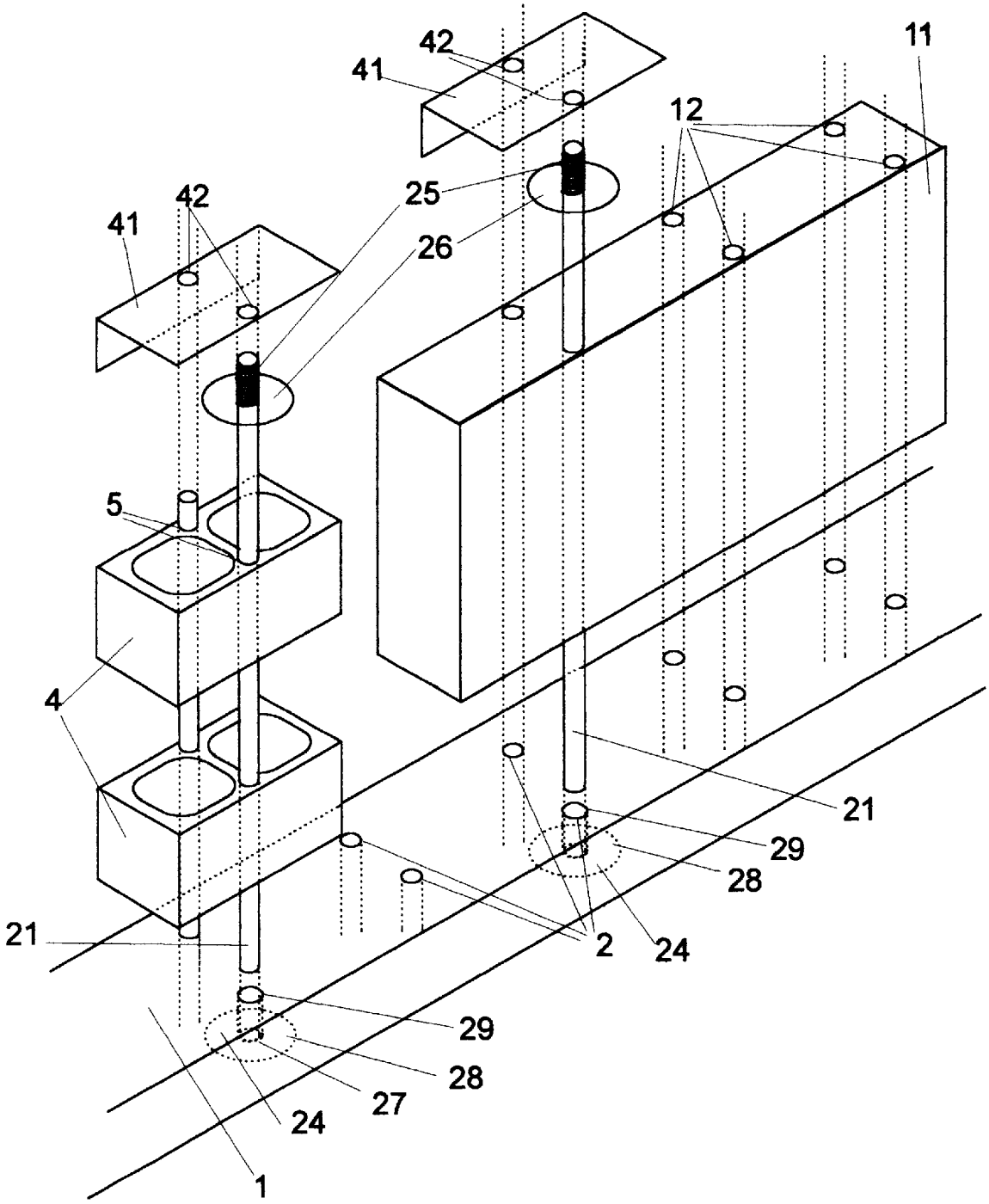
FIG. 4—Foundation, stack of concrete blocks, top plates, wall block, with enhanced block assembly rods and foundation embedded bases, exploded view.

FIG. 4 illustrates the use of this alternative and enhanced kind of structure for block assembly rods. Block assembly base plates 28 are embedded in the foundation concrete 1. Concrete blocks 4 or wall blocks 11 are placed on the foundation 1, with their preformed holes 5 or 12 aligned with the open holes 29 in the block assembly rod base plate tops. Enhanced block assembly rods 21 are then run through the concrete blocks 4 and/or wall blocks 11, such that the bottom 27 of each enhanced block assembly rod 21 rests on the base plate 24 of a block assembly rod base 28. At the top of each wall, top plate modules 41, having holes 42 that align with the enhanced block assembly rod threaded top sections 25, are placed so that they rest on the top block rod assembly plates 26. Thus, when the roof is later mounted on the top plate modules 41, the enhanced block assembly rods 21 function as thin load bearing pillars. The base plate 24 must be of sufficient area so that when base plates 24 are cast in the foundation 1 the base plates and foundation will bear the weight supported by the enhanced block assembly rods 21.

The enhanced block assembly rods 21 are inhibited from bending by the concrete blocks or wall blocks, but except for this bending prevention, the enhanced block assembly rods 21 can bear the weight of the roof independently of any vertical weight bearing function of the concrete blocks and or wall blocks. This permits the use of concrete blocks and/or wall blocks that can be made primarily with light-weight non-load-bearing material, including insulation. The light weight of such concrete blocks and/or wall blocks makes it more practical to transport buildings of the present invention considerable distances. In addition, through the use of enhanced block assembly rods and ultralight wall blocks comprising insulating material and/or structure, building designs for buildings of the present invention are facilitated that require no additional insulation.

Figure 5:
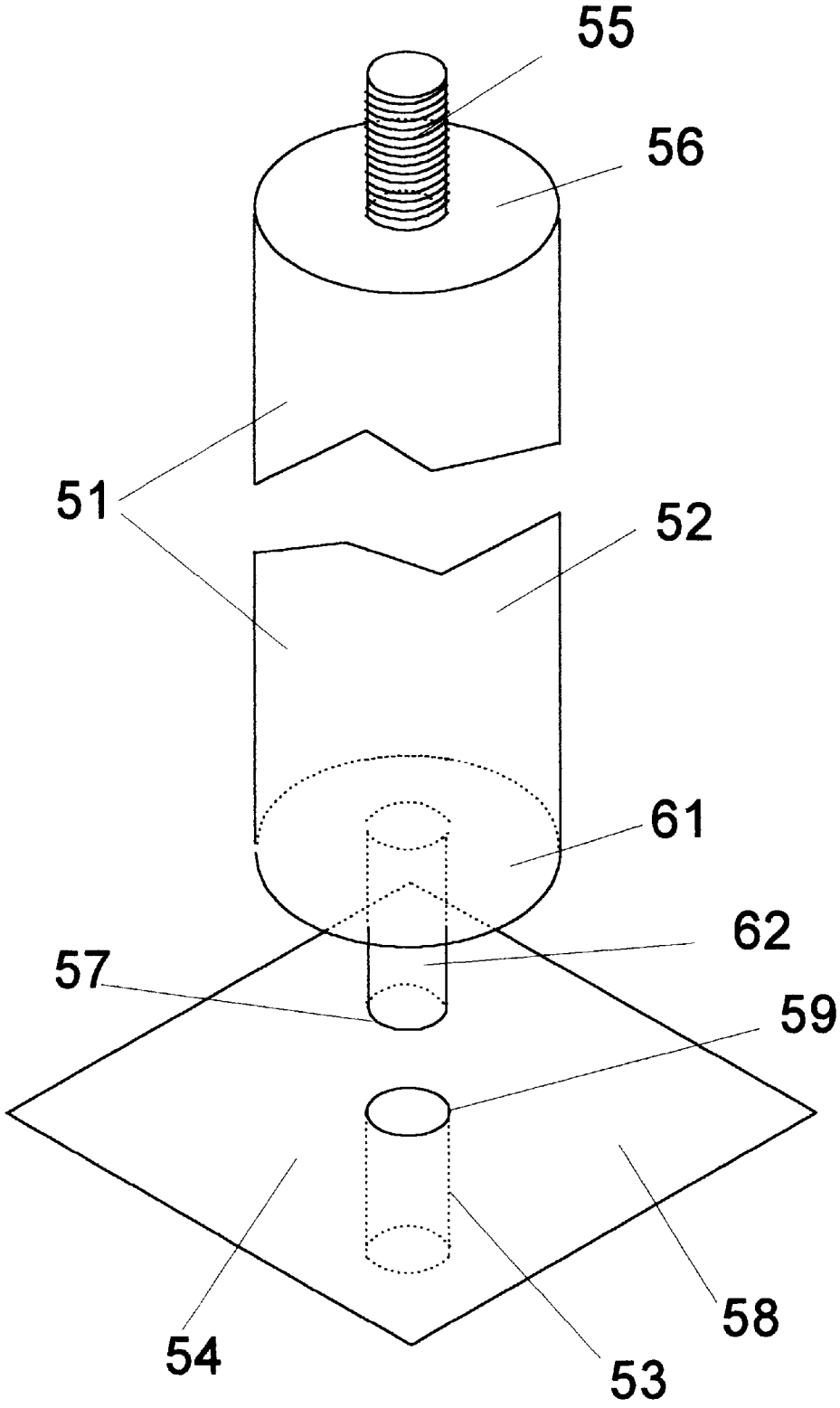
FIG. 5—Enhanced block assembly column and base, exploded view.

A third alternative and enhanced kind of structure can be used in place of block assembly rods in the system of a building of the present invention. This enhanced structure will be termed a block assembly column. A block assembly column is typically a hollow steel supporting column, similar to commercially available columns, enhanced with top and bottom sections similar to the enhanced block assembly rod of FIG. 3. Such a block assembly column, shown as 51 in FIG. 5, is typically of steel, and comprises: a hollow steel column 52 that is welded to a flat bottom column plate 61, that is in turn welded to a solid steel rod section 62 having a flat bottom 57; a flat top column plate 56 that is typically of steel and is typically welded to the top of the column 52, and a threaded top section 55 that is typically welded to the top column plate 56. The block assembly column 51 is used with a block assembly column base 58, typically of steel. The block assembly column base 58 comprises a hollow tube structure 53 that is typically welded to a plate 54. When the building foundation is formed, block assembly column bases 58 are cast in the concrete, with the plate on top of the concrete foundation, and the open hole 59 of the tube structure 53 of FIG. 5 facing up.

Figure 6:
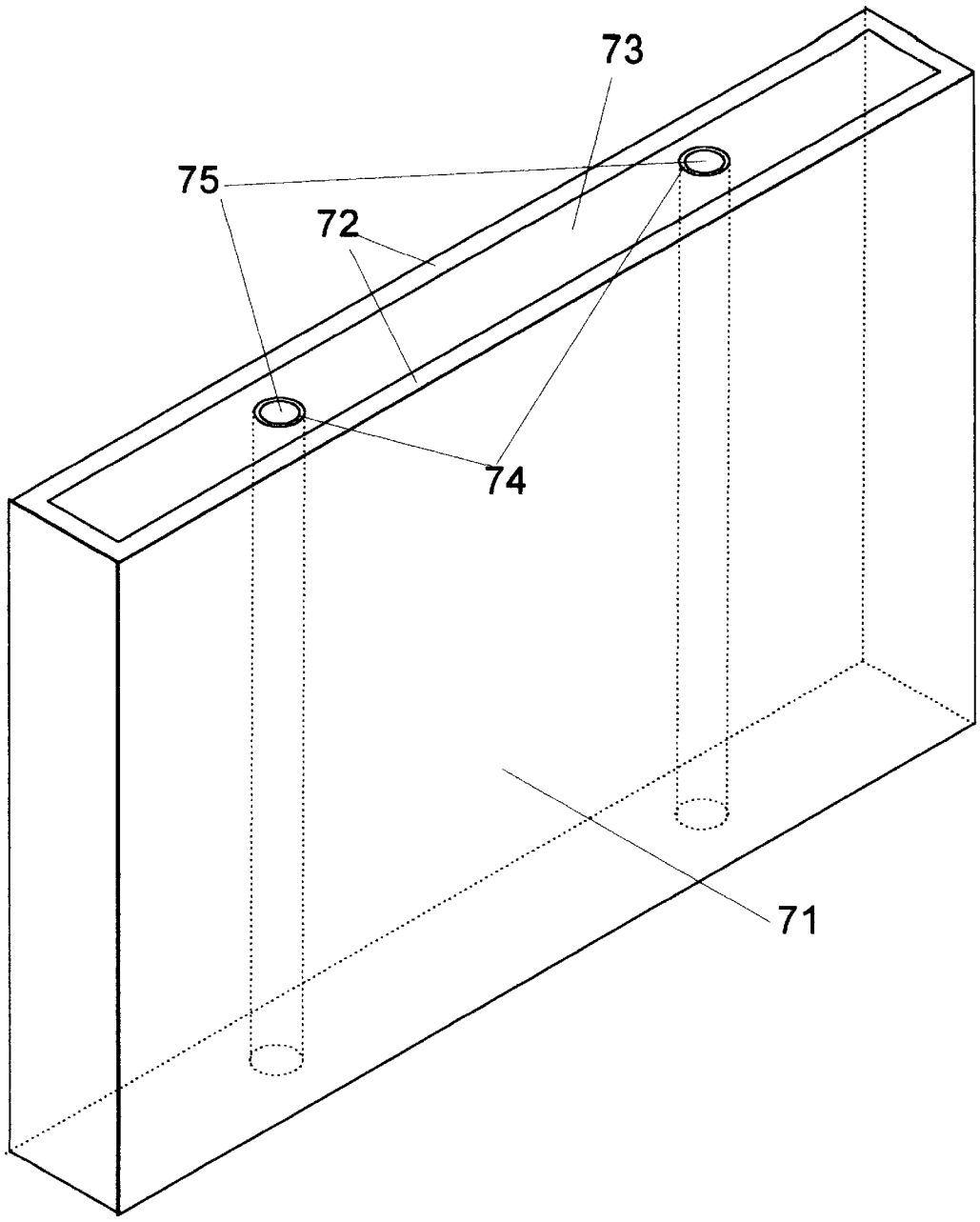
FIG. 6—Large ultra-light wall block, top isometric view.

FIG. 6 illustrates the structure of a larger ultra-light wall block unit 71 of a design and composition suitable to be used with block assembly columns described above in the system of a building of the present invention. The ultra-light wall block unit 71 comprises an outer shell 72 about 1" thick of ultra-light concrete, an inner layer 73 about 3" thick of a light but rigid foam insulating material such as polyisocyanurate foam, hole liners 74 of material such as PVC, and holes 75 that are the inside of the hole liner 74 and that are sized to accommodate block assembly columns. Ultra-light wall block units function together with block assembly columns in a building of the present invention such that when the building is assembled, the columns rest on the foundation, and provide total vertical structural support for the roof of the building. The roof rests on steel top plate modules similar to those illustrated as 41 of FIG. 4. The weight of the roof is supported from the foundation via the columns, and the columns are inhibited from bending or falling both by the steel rod sections 62 of FIG. 5, and by the encasing structure of the walls. As the building assembly continues, additional framing and wall elements add supporting structure that further enhances the function of the wall blocks 71 in preventing the columns from bending or falling.

Figure 7:
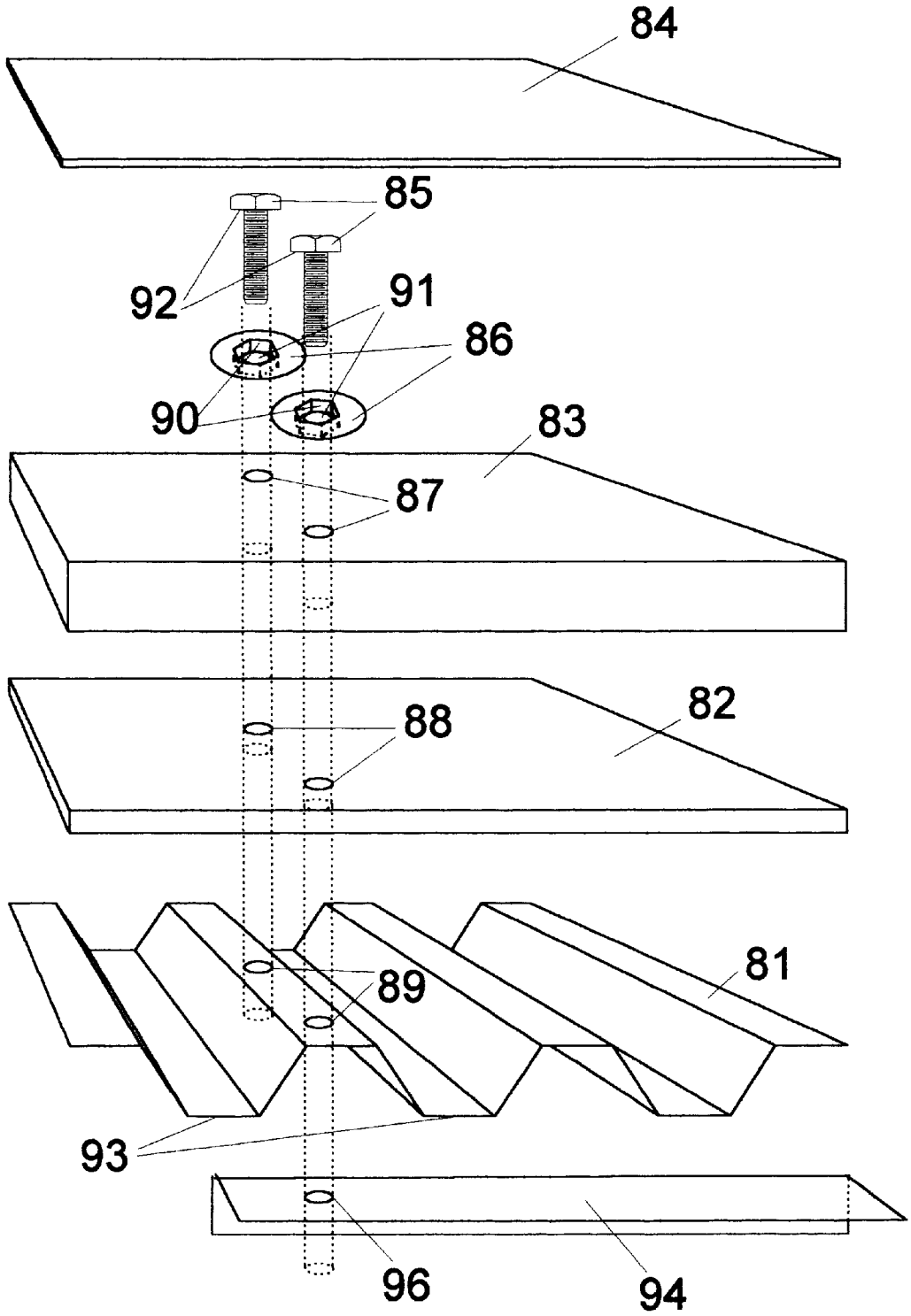
FIG. 7—Roof module components and roof angle iron frame, exploded view.

FIG. 7 illustrates primary components of a roof module for the system of a building of the present invention. Referring to FIG. 7, a roof module is comprised of up to four main layers: a layer of ribbed steel decking 81, an optional layer of platform panel 82 that is typically ½" gypsumboard, a layer of insulation panel 83 that is typically 3" polyisocyanurate foam, and a layer of a rubber membrane 84. When the roof module is assembled, bolts 85 are inserted through bolt plates 86, the layer of insulation panel 83, the optional layer of platform panel 82, and the layer of steel decking 81. There are holes 87 in the layer of insulation panel 83, holes 88 in the layer of optional platform panel 82, and holes 89 in the layer of steel decking 81, all sized and spaced to accommodate arrays of bolts spaced such as to secure the layers together, and to give the resulting assembled panel module added stiffness deriving from the structural properties of the layers. The bolt plates 86 have recessed center sections 90 to accommodate the shape of the bolt head, resulting in a relatively smooth top surface of the bolt head and the bolt plate when the bolts are secured. The bolt plates 86 have center holes 91 to allow the bolt to be inserted, and as a base for the bottoms 92 of the bolt heads. When the roof modules are assembled, some or all of the bolt heads protrude below the lower ribs 93 of the ribbed steel decking 81, and through holes 96 in a spanning angle iron 94, a section of which is shown in FIG. 7. These spanning angle irons 94 run the length of the roof, and are secured to other angle irons that are in turn secured to top plate sections around the inner perimeter of the roof. When the roof modules are bolted to these angle iron sections 94, this has the effect of both securing the roof module to the building, and indirectly to adjacent roof module sections that are also secured to the angle irons. Thus the roof module sections and the angle irons 94 are structurally an integrated load bearing unit. Although bolting, as shown in FIG. 7, is a preferred way of attaching roof modules to spanning angle irons, it should be understood that other means could be use to attach roof modules to spanning angle irons in the system of a building of the present invention.

Figure 8:
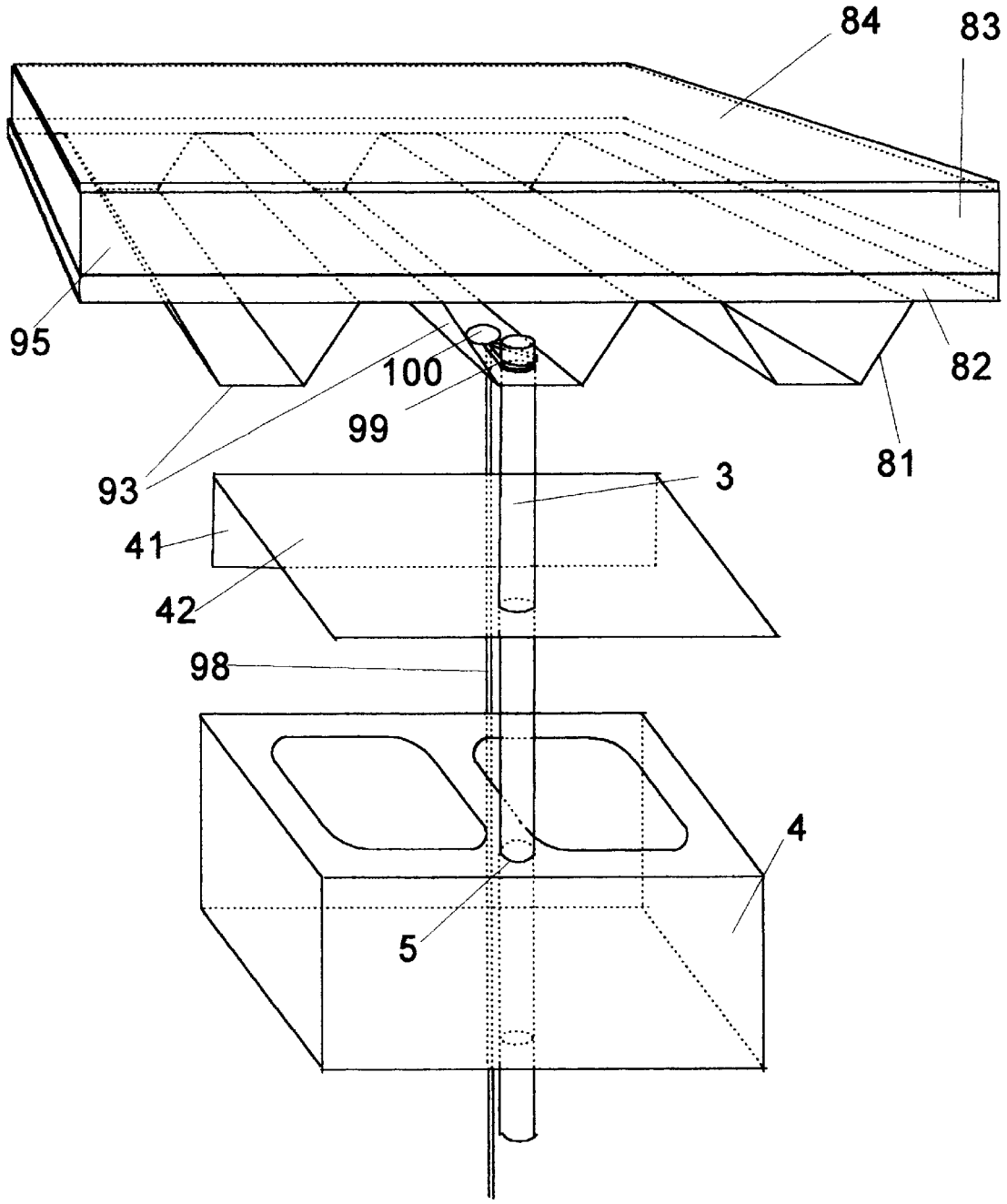
FIG. 8—Assembled roof module, flat wall top plate, roof and foundation joining structure, and concrete block, exploded view.

FIG. 8 shows an assembled roof module 95, comprising the layers described with reference to the exploded view of FIG. 7: the layer of ribbed steel decking 81, an optional layer of platform panel 82, a layer of insulation panel 83, and a layer of a rubber membrane 84. Continuing to refer to FIG. 8, the exploded view illustrates how the short ends of assembled roof modules of the system of a building of the present invention are attached to walls. The bottom rib sections 93 of the steel decking layer 81 rest on the block top plate 42, and the block top plate in turn rests either on blocks, such as the concrete block 4 illustrated in FIG. 8, or wall blocks, or a combination thereof, and/or on top rod plate sections 26 of enhanced block assembly rods 21 of FIG. 4. Referring again to FIG. 8, for some of the block assembly rods 3, plastic coated steel cables 98, with a looped end 99 are inserted through a hole 100 in the bottom rib 93 and looped around the block assembly rods 3. The other end of each cable, also looped, is attached to a protruding bolt precast in the side of the foundation, illustrated as 6 of FIG. 1. The steel cable is presized according to the height of the building, and is of a length such that it must typically be mechanically stretched to place the bottom loop on the protruding bolt 6 of FIG. 1.

Referring again to FIG. 8, because the roof modules 95 are bolted to the block assembly rods 3 that run through the top plate holes 42, cement block holes 5, and/or wall block holes, and to the foundation, with the steel cables 98 in place, the roof modules, block plates, blocks, and foundation of the system of a building of the present invention all become effectively one assembly.

Figure 9:
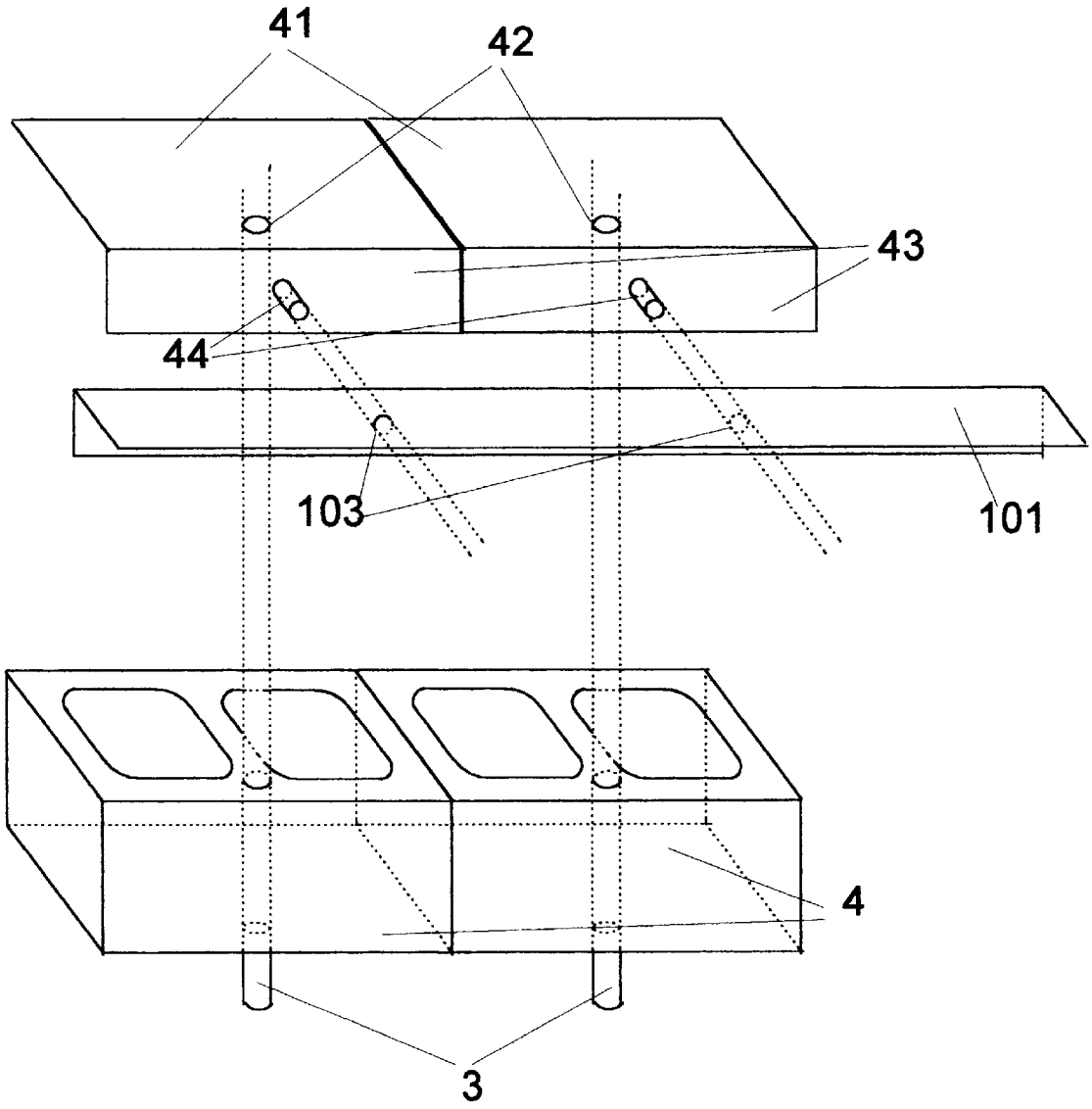
FIG. 9—Flat wall top plate sections, wall frame angle iron, and concrete blocks, exploded view.

FIG. 9 illustrates an exploded view of adjacent top plates 41, a section of angle iron 101, and the top concrete blocks 4 of two adjacent stacks of concrete blocks of the system of a building of the present invention. Sections of angle iron 101 run the length of each wall, and thus run the entire inside perimeter of a building of the present invention. The inner flange 43 of each top plate section 41 has a bolt or a section of threaded rod 44 welded to it. The angle iron sections 101 have holes 103 that are spaced to align with a row of top plate sections 41. The angle iron sections 101 are bolted to the top plate flange sections 43 using the bolt or threaded rod sections 44. In this way the building is further structurally reinforced with respect to any vertical force vector acting on a wall.

Figure 10:
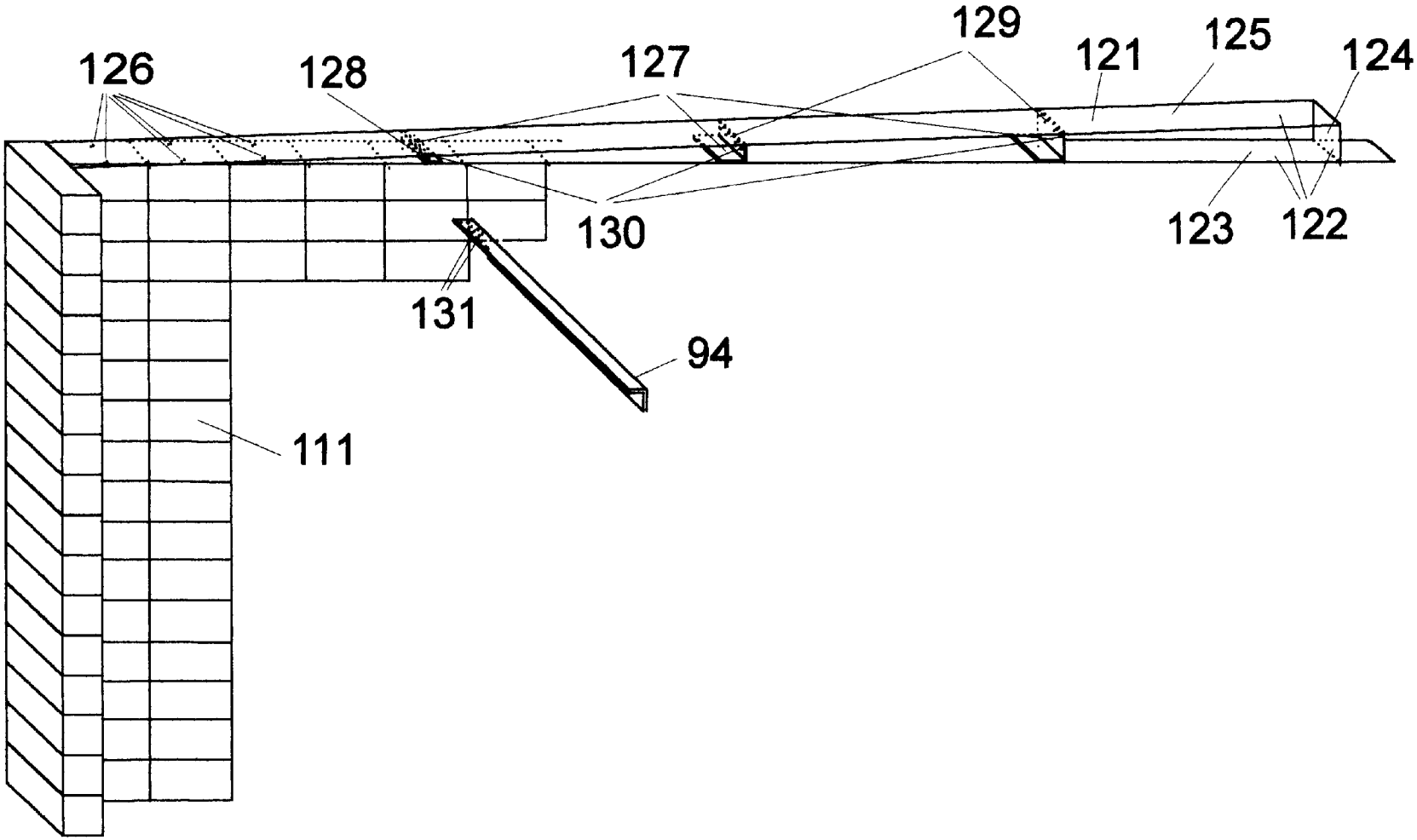
FIG. 10—Sloped wall top plate with angle iron mountings, wall section, and spanning angle iron roof framing section, explode view.
Figure 12:
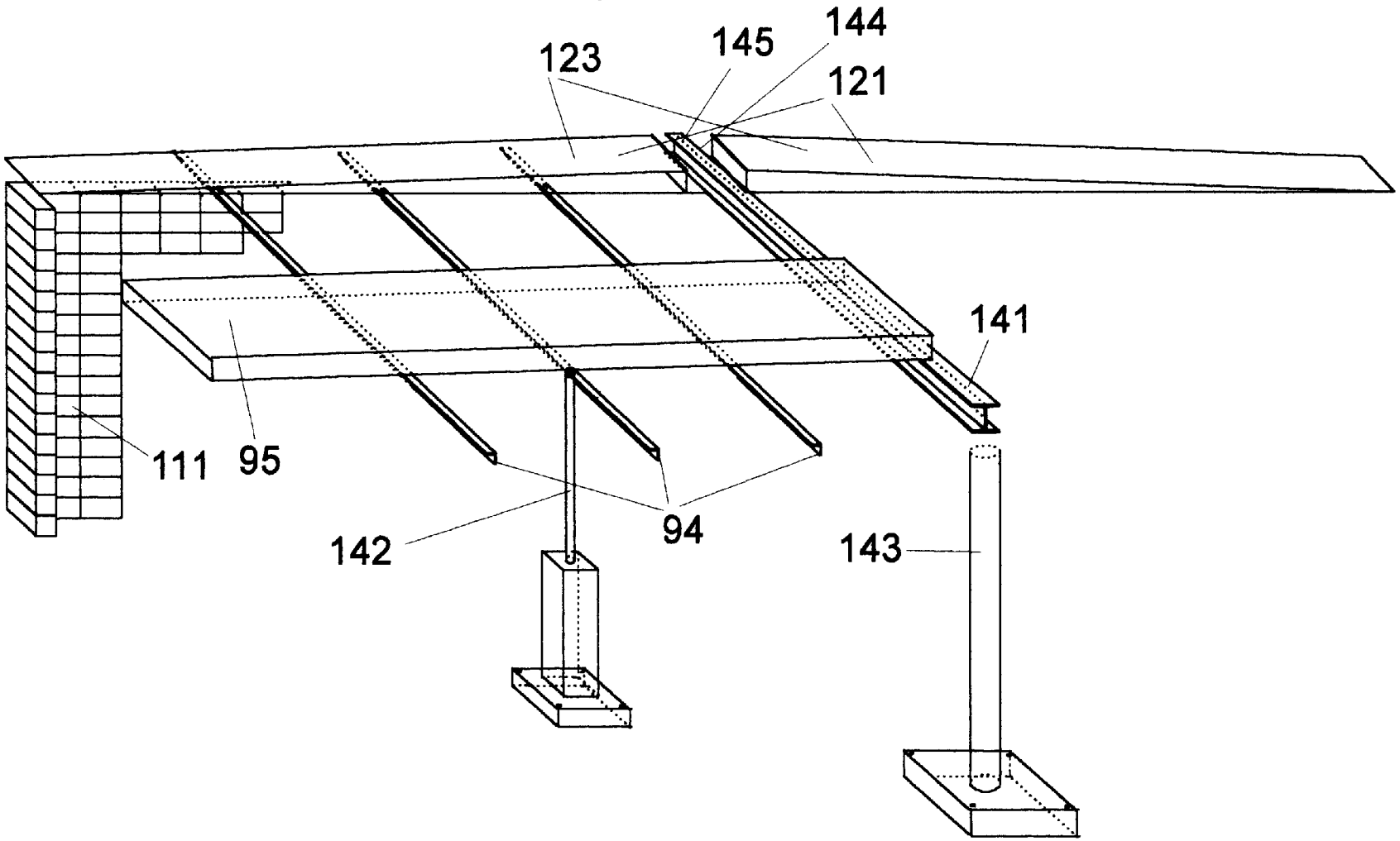
FIG. 12—Roof module, sloped wall top plates, angle iron mountings, wall section, angle iron roof framing, major supporting beam, major and minor supporting columns, isometric view.

FIG. 10 illustrates a sloped wall top module 121 of the system of a building of the present invention. These sloped wall top modules can range in length from about 12' to about 24'. When roof modules 95 are put in place, they run parallel to the sloped wall top modules, as shown in FIG. 12. Referring to FIG. 10, the sloped roof top module 121 comprises a triangular shaped frame 122, having a base plate 123 typically of steel or a similar material, a slight rise section 124 of between about 8" and 18", also typically of steel, and a top section 125 also typically of steel. There are holes 126 along the entire length of the base 123 and top section 125, corresponding to the block assembly rod holes and/or block assembly column holes. The holes 126 in the top section 125 are large enough in diameter to allow a bolt to be placed on the threaded top of a block assembly rod or column, and then to bolt the base plate 123 securely to the block assembly rod or column.

Continuing to refer to FIG. 10, the sloped wall top module 121 has angle iron mountings 127, typically at one to three points, at which steel angle irons can be attached that run perpendicular to the ribs of the roof modules. A section of one such steel angle iron 94 is shown as ready to be put in place and attached to mounting 128 of the sloped wall top module 121 of FIG. 10. The sloped wall top module angle iron mountings 127 are typically welded to the base plate 123, and have holes 130 that are used together with the holes 131 in an angle iron 94 to bolt angle irons 94 to the mountings.

Figure 11:
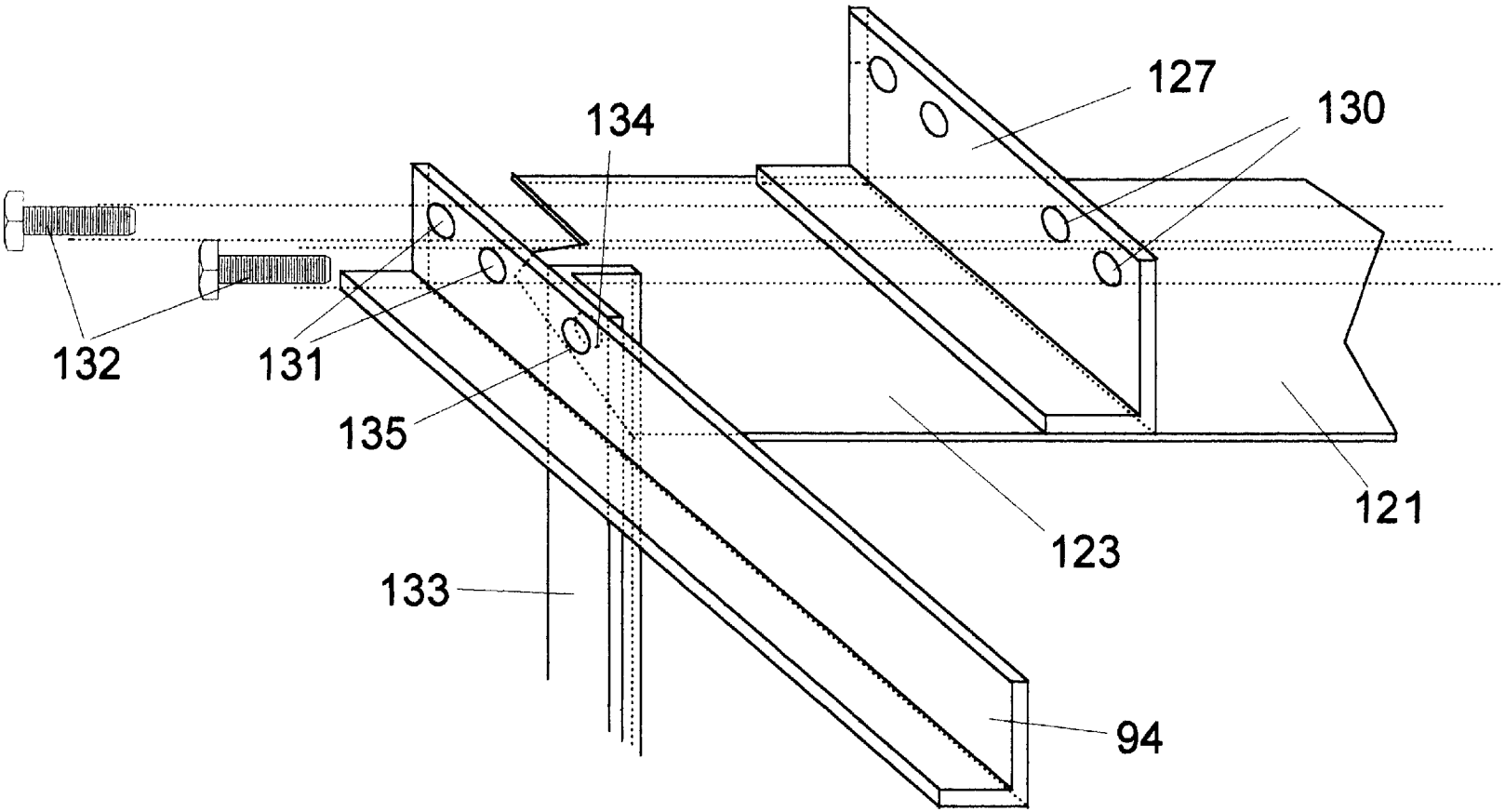
FIG. 11—Sloped wall top plate angle iron mounting, sloped wall top plate base section, spanning angle iron section, bolts, and roof and foundation linking angle iron section, exploded view.

FIG. 11 is a detail view of a mounting 127 on the base plate 123 of a section of a sloped wall top module 121, and an angle iron 94 ready to be attached to the mounting 127 of the system of a building of the present invention. The angle iron 94 is placed against the mounting 127, the holes 130 and 131 are aligned, the bolts 132 are inserted, and the angle iron 94 is thus secured to the mounting 127 and thereby to the sloped wall top module 121. Additional vertical angle irons 133 are also secured to the angle irons 94 using bolts that run through aligned holes 134 and 135 in the angle iron 133 and the spanning angle iron 94 respectively. The other end of the angle iron 133 is bolted to one of the bolts 6 embedded in the foundation 1 as shown in FIG. 1. In this way, the roof modules, the sloped wall top module, the wall, the block assembly rods and/or columns, and the foundation are all functionally one structure.

FIG. 12 is a view of two sloped wall top module sections 121, a roof module 95, a wall section 111, and primary framing elements of the system of a building of the present invention. The wall top modules are placed such that there is a slope to the roof from the joining point 144 of the two wall top modules, downward to both sides. The joining point 144 of the wall top modules 121 is recessed, allowing the placement of a major spanning beam 141, a section of which is illustrated in FIG. 12, such that the top 145 of the major spanning beam 141 is level with the sloped top plate sections 123 of the wall top module sections 121. The major spanning beam 141 is typically a steel I-beam, and spans the length of the building to the opposite wall.

Angle irons 94 are mounted to the mountings on the wall top module sections 121, as indicated in FIG. 12. The mounting of the angle irons 94 is not illustrated in FIG. 12, but was illustrated and detailed earlier with reference to FIG. 11. These angle irons span the length of the building to the opposite wall.

Both major supporting columns 143 and minor supporting columns 142 are used as framing elements in the system of a building of the present invention. These are detailed below with reference to other illustrations. As illustrated in FIG. 12, major supporting columns 143 are typically located under a major spanning beam 141. Minor supporting columns 142 are typically located under spanning angle irons 94, but can in some cases also be located under major supporting beams instead of major columns 143.

When the framing structure is in place, roof modules 95 of the system of the present invention are put in place. These roof modules 95 are secured to angle iron supports 94, as was described earlier and illustrated by FIG. 7, and one end of each roof module 95 is secured to the walls perpendicular to those with sloped wall top modules 121, as was described earlier and illustrated by FIG. 8.

Figure 13:
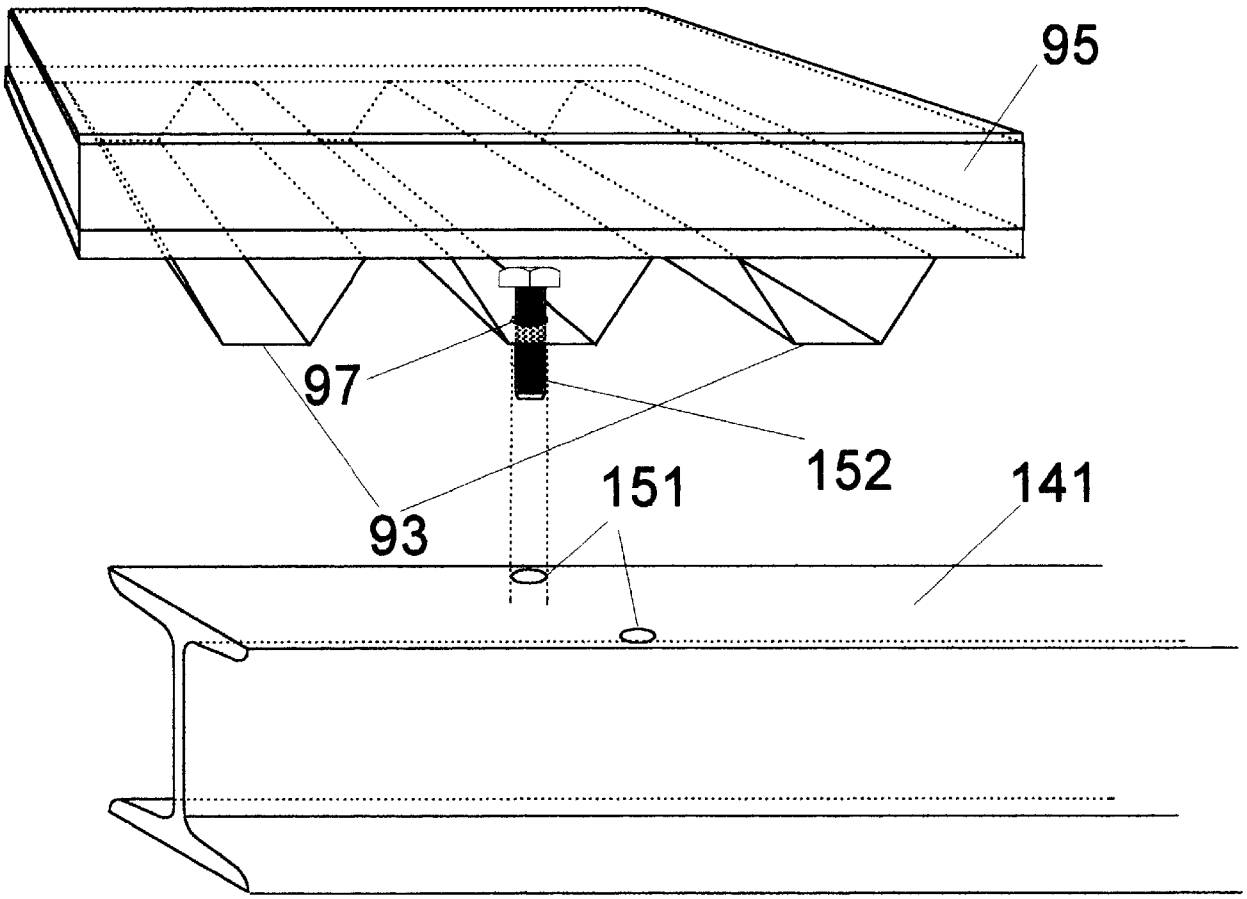
FIG. 13—Assembled roof module and major spanning beam section, exploded view.

The other end of the roof module 95 may be secured to a major spanning beam 141, as illustrated in FIG. 13, showing a section of a roof module 95 and a section of a major spanning beam 141. However, for some smaller buildings and/or sections of buildings of the present invention, both ends of roof modules 95 are secured to walls, and only one sloped wall top module 121 is used. When a major spanning beam is used, the spanning beam 141 has holes 151, that are spaced to correspond with holes 97 in bottom ribs 93 of the roof module 95. Bolts 152 are placed in holes 97 of the bottom ribs 93 of the roof module 95. The roof modules 95 are placed on the roof such that the holes 97 and 151 are aligned, and thus the bolts 152 drop through the holes 151 in the major spanning beam 141, nuts are placed, and the roof modules 95 are thus secured to the major spanning beam 141.

Figure 14:
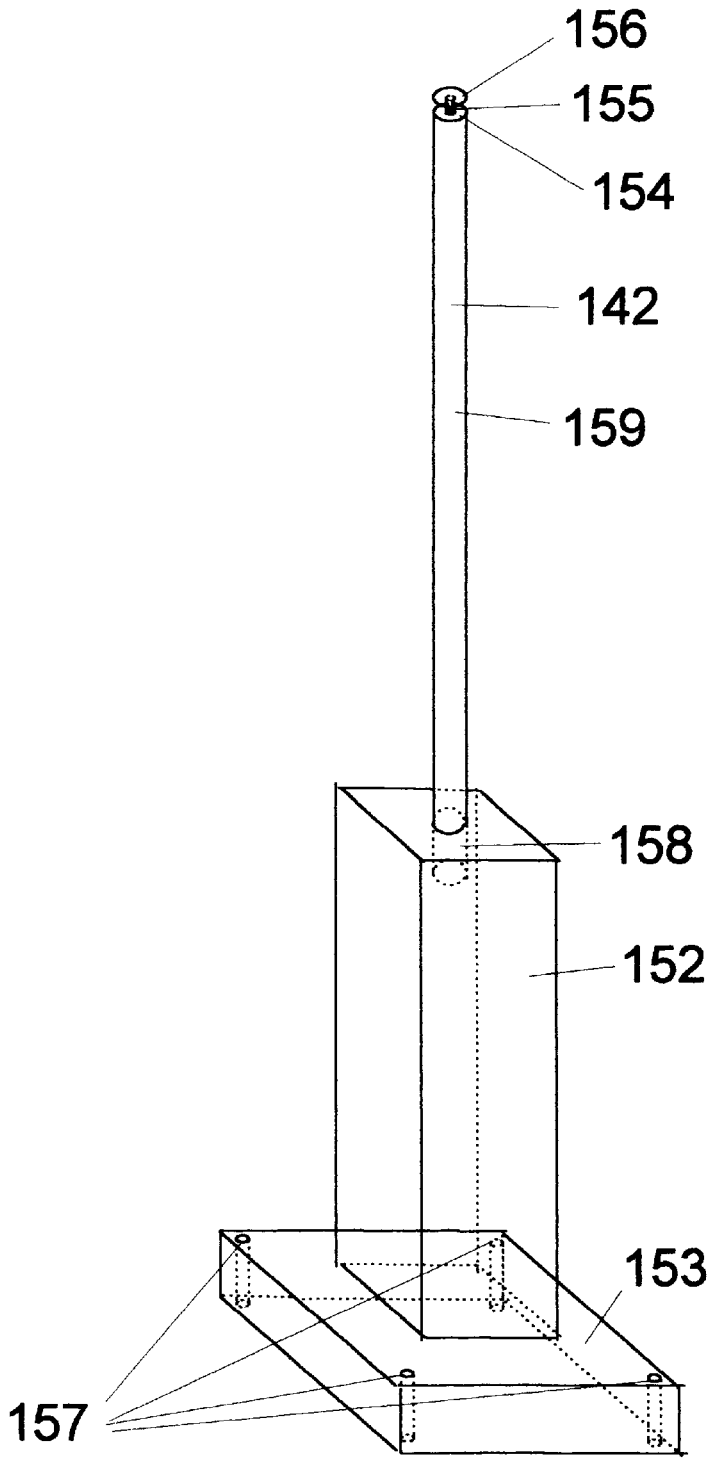
FIG. 14—Minor supporting pillar, isometric view.

FIG. 14 illustrates a minor supporting pillar 142 of the system of a building of the present invention. This typically comprises a hollow steel tube section(s) 159, an optional pre-cast concrete column section 152, an optional pre-cast concrete base 153, and a top assembly further comprising a threaded top plate 154, a threaded rod section 155, and a roof supporting top plate 156. The threaded rod section 155 is used to adjust the overall height of the minor supporting pillar 142 within a range of up to a few inches. The pre-cast concrete base can be pinned to the ground or to existing pavement by running rods of steel or similar material through the preformed holes 157. The top part of the minor supporting pillar 142, from the hollow steel tube section(s) 159 up, can be placed in a hole 158 that is pre-cast in the concrete column section 152, or can be permanently embedded in the concrete column section 152. The top part of the minor supporting pillar 142, from the hollow steel tube section(s) 159 up, is commercially available in structures that typically are designed to support about 10,000 lbs.

Figure 15:
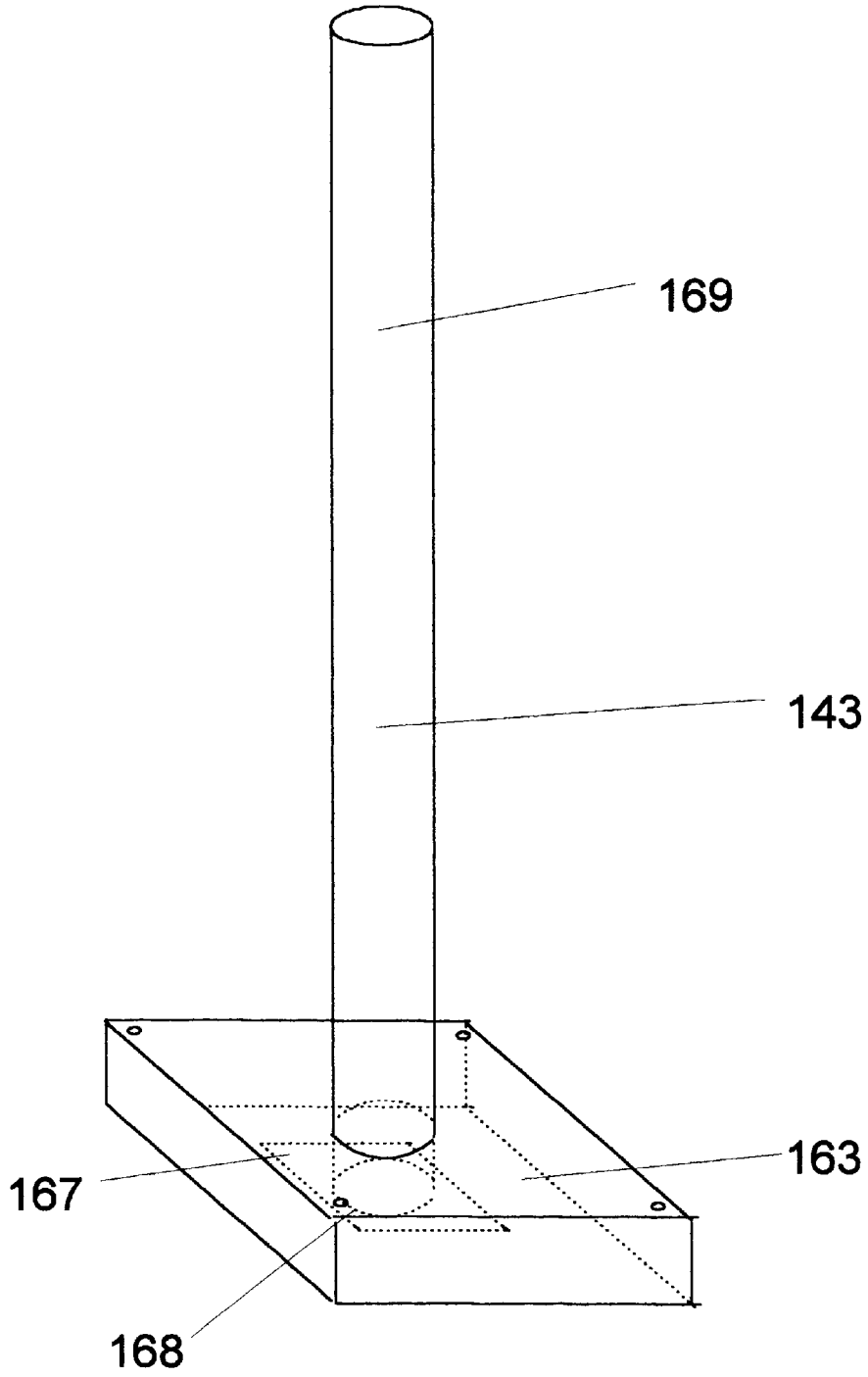
FIG. 15—Major supporting pillar, isometric view.

FIG. 15 illustrates a major supporting pillar 143 of the system of a building of the present invention. This typically comprises a steel tube section 169, and a pre-cast concrete base 163. The steel tube section may be hollow, or may be filled with concrete and/or with additional steel reinforcing. The major supporting pillar is sized so that when it is in place its height corresponds to the height of an installed major spanning beam such as the spanning beam section 141 shown in FIG. 12. The steel tube section 169 may be either permanently mounted in the pre-cast concrete base 163, or may be placed in a pre-formed hole 168. An optional steel base plate 167 may be cast in the pre-cast concrete base 163.

Figure 16:
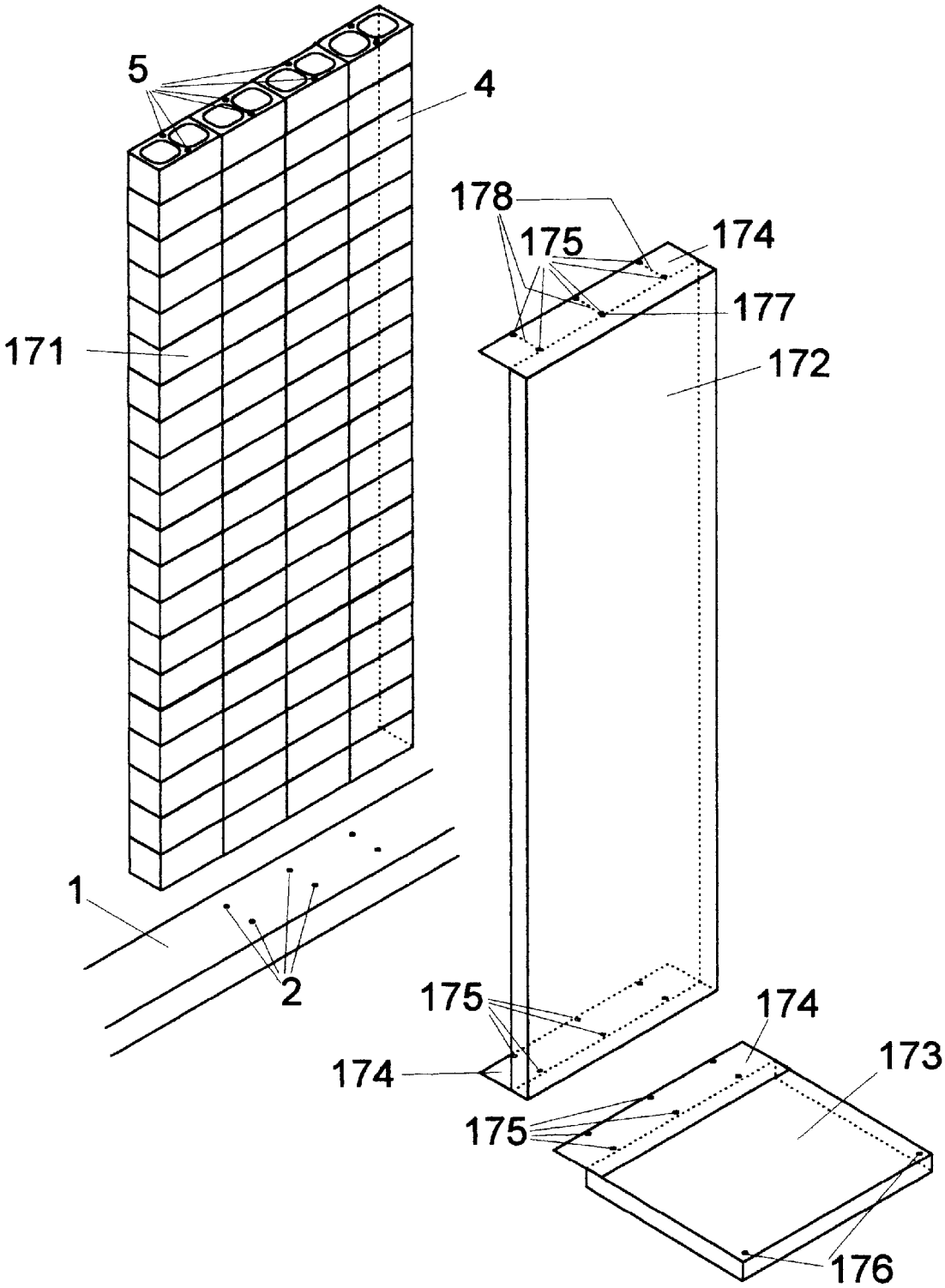
FIG. 16—Wall section, foundation, wall insulation panel, and foundation insulation panel, exploded view.

FIG. 16 illustrates an optional wall insulation panel 172 and an optional foundation insulation panel 173, shown with a wall assembly 171 of the system of a building of the present invention. The foundation and wall insulation panels can be installed together, or separately. The wall insulation panels 172 can be installed on either the inside or the outside of the building. The panels have thin, flexible insulation panel end sections 174, with block assembly holes 175 that correspond to the pattern of holes 5 in the concrete blocks 4 and/or wall blocks used for the walls. To install wall insulation panels, one insulation panel end section 174 is placed on the foundation, and typically secured by block assembly rods or other rods that run through the block assembly holes. If both wall and foundation insulation panels are used, the end section 174 of the foundation insulation panel 173 is placed on the foundation 1 first, followed by placement of the wall insulation panel 172 end section 174. The wall block is then installed.

Wall insulation panels such as 172 of FIG. 16 are sized with respect to a standard wall height. When all the wall blocks are in place, installation of the wall insulation panel 172 can be completed. The side of the wall insulation panel 172 can be optionally spot glued with a suitable adhesive, following a standardized pattern of adhesive placement that will facilitate later removal. The wall insulation panel 172 is then pressed or braced firmly against the wall 171 to ensure a permanent adhesive bond. The block assembly rod corresponding to block assembly hole 177 of FIG. 16 is removed if it is in place, and the top insulation panel end section is cut along lines 178 of FIG. 16, so that the top insulation panel end section 174 can be placed flat on the blocks. When the block assembly rod corresponding to the block assembly hole 177 is in place, the top of the insulation panel 172 is thus secured from moving away from the wall.

When foundation insulation 173 is installed, once the end section 174 is secured to the foundation 1, the panel can optionally be pinned to the ground or to pavement by running securing rods, nails or spikes through holes 176 at the end of the panel section. Alternatively, the foundation insulation panels can be weighted, or secured to the ground in another way that may be preferable due to characteristics of a specific site and building of the present invention.

Figure 17:
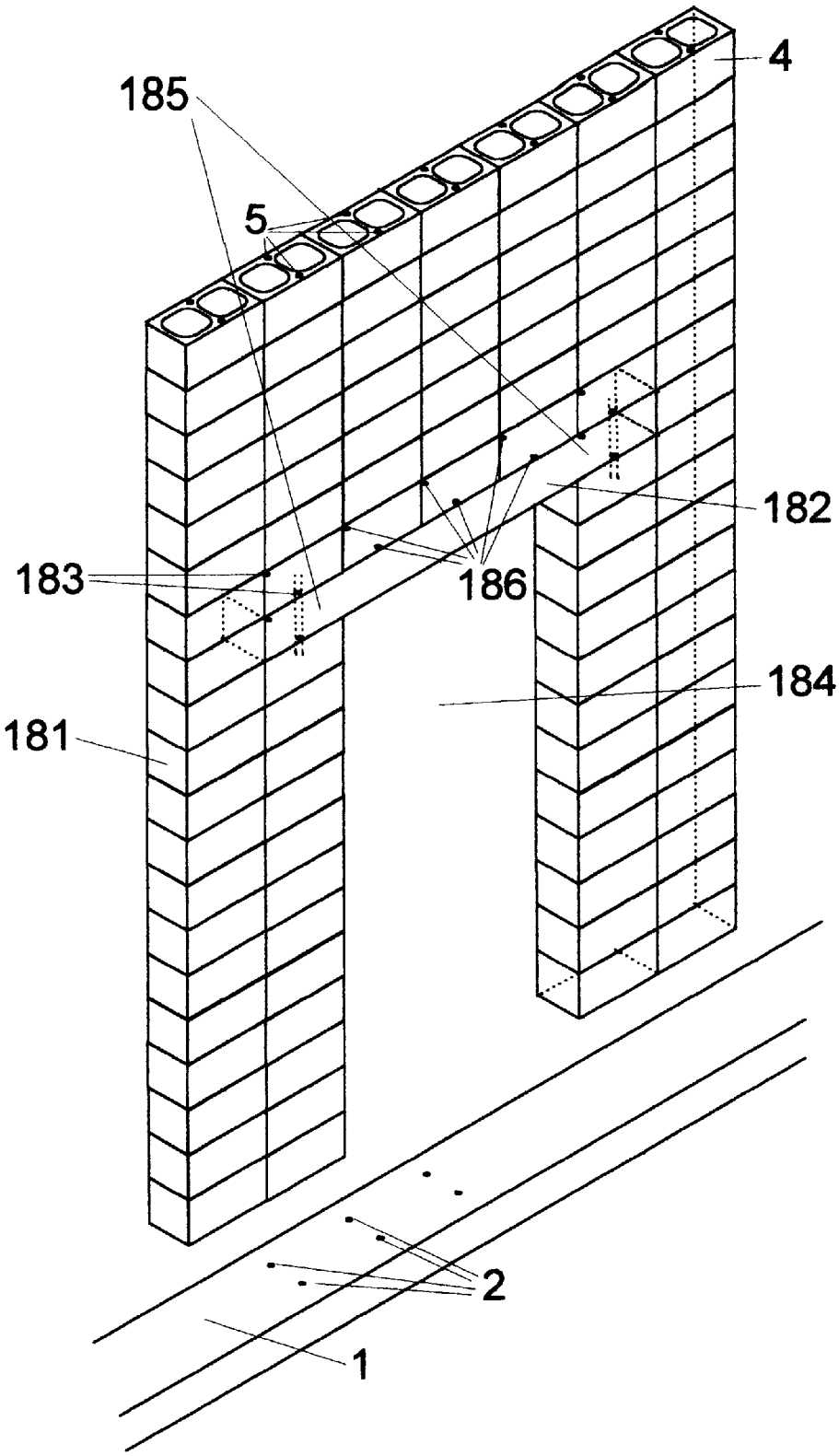
FIG. 17—Wall section, door opening, and lintel, isometric view.

FIG. 17 illustrates a view of a door opening and lintel assembly for a wall of the system of a building of the present invention. The section of assembled concrete block wall 181 of FIG. 17 has an opening 184 within which a door frame, garage door frame, or window frame, can be placed, as with conventional concrete block or concrete wall buildings. If a window is placed, additional wall block would typically rise from the foundation to the bottom of the window, assembled with shorter block assembly rods. Above the opening 184 is a lintel 182, typically of reinforced concrete. The lintel 182 has block assembly rod holes 183 that align with the block assembly rod holes 5 in the stacks of blocks that the sides 185 of the lintel are placed in. The block assembly rods run through the lintel as they do through concrete blocks and/or wall blocks. The lintel also has holes 186 that correspond to the holes for block assembly rods that run through the blocks above the lintel, if any. These holes 186 typically run all the way through the lintel, and have enlarged lower ends to allow for shorter block assembly rods to be bolted at both ends to assemble the lintel and blocks above the lintel.

Figure 18:
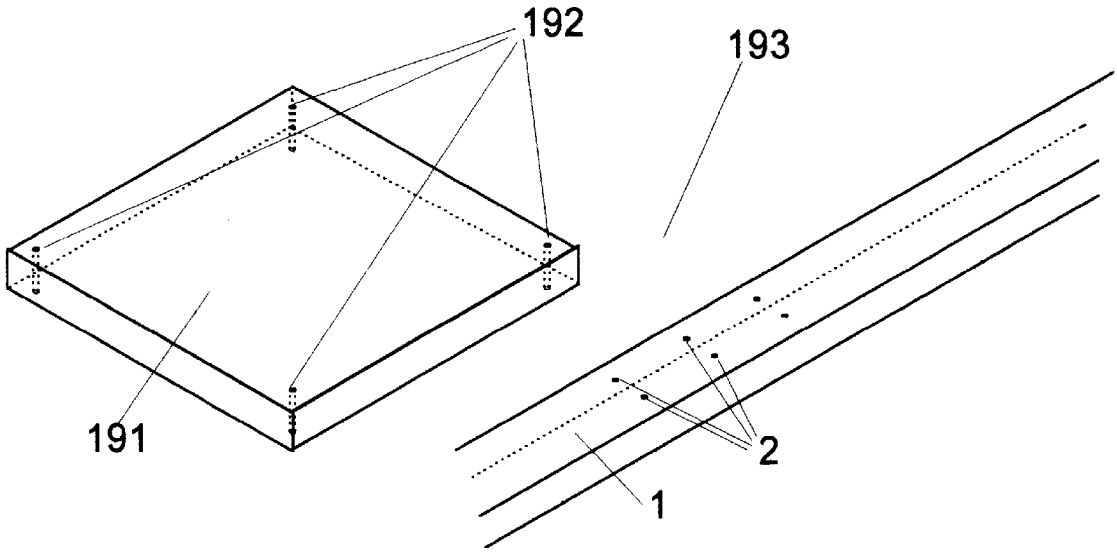
FIG. 18—Floor components, exploded view.

FIG. 18 illustrates a view of a floor module 191 of the system of a building of the present invention, near a section of foundation 1. Floor modules 191 may be placed on a leveled surface 193 inside the foundation perimeter. They typically adjoin other floor modules and the foundation 1. Holes 192 are in the floor modules 191, allowing the floor modules to be pinned to the ground. If the ground is sufficiently leveled, and offers sufficient support, such pinning may be unnecessary. The holes 192 can also be used with cable and other means to easily place the floor modules adjacent to one another. Alternatively, if a building of the present invention is being placed on an already paved surface, floor modules may not be needed.

Figure 19:
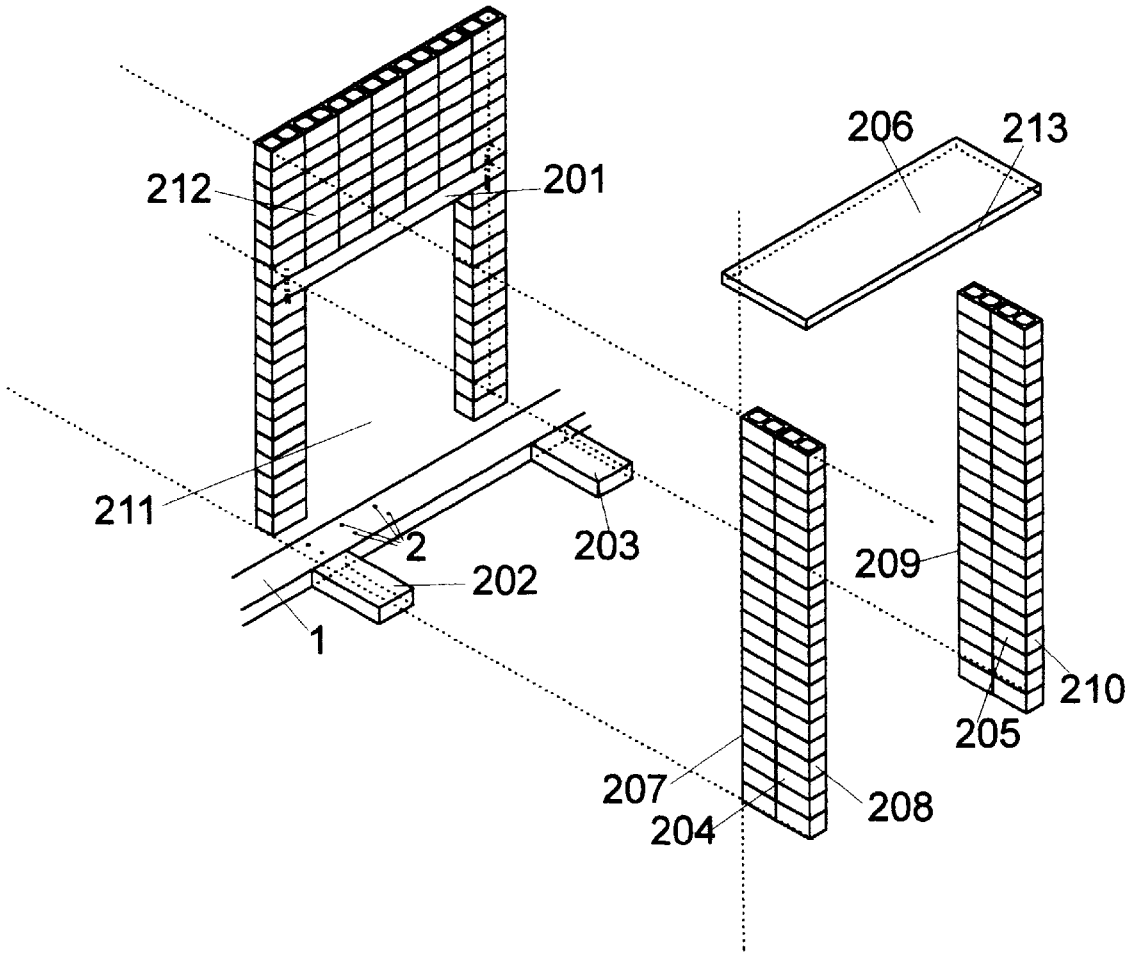
FIG. 19—Building link components, exploded view.

FIG. 19 illustrates an exploded view of a building link component of the system of a building of the present invention. A building link component is a short passageway from a building of the present invention to a pre-existing adjacent building. A building link may connect with a pre-existing garage door of an adjacent building, or may be placed at a point where it is necessary to cut an opening into the pre-existing building. FIG. 19 illustrates an exploded view of a building link component of a building of the present invention. There is an opening 211, such as a garage door opening, in a wall section 212 of a building of the present invention. A lintel 201 is above the opening 211. There are two extensions 202 and 203 to the foundation 1, adjoining the opening in the pre-existing building. Wall sections 204 and 205 are situated on the foundation extensions 202 and 203 respectively. The sides 207 and 209 of the wall sections 204 and 205 adjoin the wall section 212. A customized roof module 206 tops the wall sides 204 and 205, and sits adjacent to the roof modules on the new building, not shown in FIG. 19. The customized roof module 206 comprises the elements of a standard roof module as described earlier with reference to FIG. 7, but is custom built, and sized to the specific dimensions of a specific building link component. A section of rubber membrane is glued to the main roof modules of the building of the present invention, and to the customized roof module 206, and gutters and flashing are then added as required to finish the roof.

If the pre-existing building roof is higher than the building roof level of the present invention, then the edge 213 of the customized roof module 206 of the building of the present invention abuts the pre-existing building, and is typically sealed to the pre-existing building wall at the building interface with a waterproof adhesive compound. If the roof level of the building of the present invention is higher than the pre-existing building, an additional custom side section, not shown in FIG. 19, must be attached to the sides 208 and 210 of the wall sections 204 and 205 respectively. Such a side section may be of the same composition of the customized roof module 206, or may be of a different composition, depending on specifics of the pre-existing building. This element of the building link component of the present invention is not standardized.

The engineering design component of the system of a building of the present invention comprises a set of engineering parameters for combinations of components of a building of the present invention such that any use of a specific combination of components within the set of engineering parameters has been pre-determined to be structurally sound. As an example, it may be determined that for a range of specific floor dimensions, a specific number of parallel spanning roof angle irons, spaced at a specified range of distances, and a spacing of angle iron supporting minor supporting columns of no greater than a specific distance will constitute a specific building design of a building of the present invention that is structurally sound from an engineering point of view. Engineering design parameters may also be defined for a set of standard building link components. The engineering design component of the system of a building of the present invention thus reduces the engineering cost of rendering specific buildings of the present invention.

The architectural design component of the system of a building of the present invention typically comprises a floor and foundation plan and drawing that is unique to the building site, and an additional set of drawings that are modifications of template drawings, and are rendered for a specific project by editing the templates. The template drawings show floors, foundations, walls, roofs, and building links for a building of the present invention. The edited template drawings of a building of the present invention show how specific foundations, walls, doors, windows, framing, roofs, and building links of a building of the present invention are to be rendered. Because the basic structural design for all but the floor plan drawing can typically be prepared by editing templates, the architectural design component of the system of a building of the present invention thus reduces the architectural cost of rendering specific buildings of the present invention. Elements such as wiring, ventilating, heating, air conditioning, plumbing and sprinkler systems are custom designed with respect to the requirements of each building of the present invention, and are beyond the scope of the present invention.

The disassembly plan component of the system of a building of the present invention typically is prepared for each building shortly before the building is to be disassembled. The disassembly plan component specifies where the disassembled components of the specific building are to be sent, and how and where at the site they are to be staged for shipping. The disassembly plan component is prepared with respect to the construction requirements and timetables for other buildings of the present invention that are being assembled using components from the building being disassembled.

Any or all of: electrical, plumbing, heating, air conditioning, and sprinkler systems may be developed as modular systems to be used with buildings of the present invention, or may be installed conventionally once a building of the present invention is in place. Building components such as those enumerated in this paragraph are beyond the scope of the present invention.

While preferred embodiments of the system of a building of the present invention have been described, it should be appreciated that various modifications may be made by those skilled in the art without departing from the spirit and scope of the present invention. Accordingly, reference should be made to the claims to determine the scope of the present invention.

I claim:

1. A building system, comprising:

a. A foundation of poured, leveled concrete, said foundation having vertical foundation holes spaced at regular intervals, and b. A plurality of concrete blocks, each said block having one or more cavities, each said block having a standardized dimension of length, each said block having one or more vertical block assembly holes at a standardized location(s) on the top of the said block, and each said vertical block assembly hole running entirely through the said block, and c. A plurality of block assembly rods, each said block assembly rod comprising a first end sized to fit in said vertical foundation holes, a second end, and a length sized with respect to a standard wall height, and d. Said foundation, said regular intervals of vertical foundation hole locations, said concrete blocks, said concrete block vertical block assembly holes, and said block assembly rods, being such that when the said concrete blocks are stacked in columns of a standardized height on the said foundation, with for each said column of concrete block(s) one or more of the said block assembly holes of each said concrete block in the column being aligned with one of the said regularly spaced vertical foundation holes, said block assembly rods are inserted through the said vertical block assembly holes in the said columns of concrete so that the said first end of each block assembly rod is in a said vertical foundation hole, the said second end of each block assembly rod is above the level of the top block of the said column of blocks, and each said column of blocks directly adjoins an adjacent column of blocks, and e. A set of sloped wall top plates on a first set of parallel walls, each said sloped wall top plate having a flat base with holes such that said block assembly rods run through the said sloped wall top plate base, and each said sloped wall top plate having one or more mounting angle irons attached to the said sloped wall top plate, said mounting angle irons delineating the said sloped wall top plate into sections, and each said mounting angle iron having one or more holes of a standardized size and location, and f. A framing structure, comprising one or more spanning angle iron sections, each end of each said spanning angle iron section being bolted to one of a facing pair of mounting angle irons on one of two parallel sloped top plates, and each said spanning angle iron having roof bolting holes spaced at standardized intervals, and g. Said framing structure further optionally comprising one or more minor supporting pillars, each said minor supporting pillar being placed underneath, and vertically supporting, a said spanning angle iron, and h. Said framing structure further optionally comprising one or more steel I-beam major spanning beam(s), such said major spanning beam(s) having two sets of holes spaced at standardized intervals, one said set of holes being on each of the two sides of the upper flange of the said major spanning beam, and i. A plurality of roof modules, each said roof module comprising a base layer of ribbed steel roof decking with said ribs running parallel to the longer sides of the said roof module, a layer of insulation board, a top membrane layer, means for attaching the said roof modules to the said spanning angle irons, and a set of holes on each of the shorter sides of the said roof modules such that each shorter side of the said roof module can either be bolted to one or more said block assembly rods or bolted to a side of the upper flange of a said optional major spanning beam.

2. The building system of claim 1, further comprising a set of vertical roof and foundation joining structural elements, each said roof and foundation joining structural element being sized to a standard building height and having a tensile strength comparable to or greater than ⅛" diameter steel cable, such that each said roof and foundation joining structural element is secured to both the roof and the foundation of the said building.

3. The building system of claim 2, further comprising attachment of all the building elements such that the entire building and foundation function as one physical structure.

4. The building system of claim 1, further comprising a plurality of foundation insulating panels, each said foundation insulating panel comprising: a layer of insulation material inside a vapor barrier; one panel side finished to serve as an exterior side; and one thin, flexible end panel with one or more holes sized and placed to align with said vertical foundation holes, such that when the said flexible end panel is placed on the said foundation, and holes of the said flexible end panel and the said foundation are aligned, the said foundation insulating panel rests on the ground with the exterior side up, and is secured to the said building by the placement of said concrete blocks and said block assembly rods.

5. The building system of claim 1, further comprising a plurality of side insulating panels that may be placed on either the inside or the outside of the building, each said side insulating panel being sized to a standard wall height and comprising: a layer of insulation material inside a vapor barrier; one panel side finished to serve as an exterior side; and a thin, flexible end panel at each of the top and bottom ends of the said side insulating panel, each said end panel having one or more holes sized and placed to align with said vertical foundation holes, such that when a first said flexible end panel is placed on the said foundation, and holes of the said first flexible end panel and the said foundation are aligned, and a second said flexible end panel is aligned with vertical block assembly holes on the top concrete block of a said concrete block column placed on the said first flexible end panel, and said block assembly rods are in place, the said side insulating panel is secured to the side of the said building.

6. The building system of claim 1, further comprising a set of flat wall top plates placed on the top concrete blocks of a second set of parallel walls perpendicular to the said first set of parallel walls having sloped wall top plates, said flat wall top plates having holes such that the said block assembly rods run through the said flat wall top plates, and each said flat wall top plate having one or more threaded bolt structures at a standardized location on the said top plate.

7. The building system of claim 6, further comprising a steel inside perimeter structure comprising sections of steel angle iron running along the inner perimeter of the said building walls, adjacent sections of said steel angle iron being joined, and said sections of steel angle iron being joined to the said flat top plate and sloped top plate structures, so as to form top plate sections and inner perimeter angle iron sections into one perimeter structure.

8. The building system of claim 1, further comprising a set of standardized lengths of roof modules and a set of standardized lengths of sloped wall top plates, such that designs for specific buildings of the present invention having floor plans comprising one or more adjoining rectangular areas of a range of rectangle lengths and rectangle widths, can be prepared to fit a specific building of the present invention to adjoin pre-existing structures of a wide variety of shapes and sizes.

9. The building system of claim 8, further comprising a system of engineering specifications such that for one or more sets of modular structural elements, any combination of the said structural elements wherein each element is within a pre-determined range of specifications as to length, spacing, and the like, will be pre-determined to meet an acceptable engineering standard for a building of the present invention.

10. The building system of claim 9, further comprising a system of architectural templates specific to components of a building of the present invention, such that an architectural design for a building of the present invention that is specific to characteristics of an existing site which may or may not have one or more preexisting buildings, can be efficiently and economically rendered.

11. The building system of claim 1, further comprising the said plurality of concrete blocks having dimension of length of 18".

12. A building system, comprising:

a. A foundation of poured, leveled concrete, said foundation having vertical foundation holes spaced at regular intervals, and b. A plurality of concrete blocks, each said block having one or more cavities, each said block having dimensions 7⅝"×7⅝×15⅝", each said block having one or more vertical block assembly holes at a standardized location(s) on the top of the said block, and each said vertical block assembly hole running entirely through the said block, and c. A plurality of block assembly rods, each said block assembly rod comprising a first end sized to fit in said vertical foundation holes, a second end, and a length sized with respect to a standard wall height, and d. A plurality of block joining panel sections, each said block joining panel section comprising slightly compressible material such as insulating foam, each said block joining panel having a thickness of approximately 2⅜", a width of approximately 7⅝", and a standardized height in a range of from 7" to 20', and e. Said foundation, said regular intervals of vertical foundation hole locations, said concrete blocks, said concrete block vertical block assembly holes, said block assembly rods, and said block joining panel sections being such that when the said concrete blocks are stacked in columns of a standardized height on the said foundation, with for each said column of concrete blocks one or more of the said block assembly holes of each said concrete block in the column being aligned with one of the said regularly spaced vertical foundation holes, with one or more sections of block joining panel separating adjacent said columns of concrete blocks such that the concrete block stacks are spaced at horizontal intervals of approximately 18", said block assembly rods are inserted through the said vertical block assembly holes in the said columns of concrete so that the said first end of each block assembly rod is in a said vertical foundation hole, and the said second end of each block assembly rod is above the level of the top block of the said column of blocks, and f. A set of sloped wall top plates on a first set of parallel walls, each said sloped wall top plate having a flat base with holes such that said block assembly rods run through the said sloped wall top plate base, and each said sloped wall top plate having one or more mounting angle irons attached to the said sloped wall top plate, said mounting angle irons delineating the said sloped wall top plate into sections, and each said mounting angle iron having one or more holes of a standardized size and location, and g. A framing structure, comprising one or more spanning angle iron sections, each end of each said spanning angle iron section being bolted to one of a facing pair of mounting angle irons on one of two parallel sloped top plates, and each said spanning angle iron having roof bolting holes spaced at standardized intervals, and h. Said framing structure further optionally comprising one or more minor supporting pillars, each said minor supporting pillar being placed underneath, and vertically supporting, a said spanning angle iron, and i. Said framing structure further optionally comprising one or more steel I-beam major spanning beam(s), such said major spanning beam(s) having two sets of holes spaced at standardized intervals, one said set of holes being on each of the two sides of the upper flange of the said major spanning beam, and j. A plurality of roof modules, each said roof module comprising a base layer of ribbed steel roof decking with said ribs running parallel to the longer sides of the said roof module, a layer of insulation board, a top membrane layer, means for attaching the said roof modules to the said spanning angle irons, and a set of holes on each of the shorter sides of the said roof modules such that each shorter side of the said roof module can either be bolted to one or more said block assembly rods or bolted to a side of the upper flange of a said optional major spanning beam.

13. The building system of claim 12, further comprising a set of vertical roof and foundation joining structural elements, each said roof and foundation joining structural element being sized to a standard building height and having a tensile strength comparable to or greater than ⅛" diameter steel cable, such that each said roof and foundation joining structural element is secured to both the roof and the foundation of the said building.

14. The building system of claim 13, further comprising attachment of all the building elements such that the entire building and foundation function as one physical structure.

15. The building system of claim 12, further comprising a plurality of foundation insulating panels, each said foundation insulating panel comprising: a layer of insulation material inside a vapor barrier; one panel side finished to serve as an exterior side; and one thin, flexible end panel with one or more holes sized and placed to align with said vertical foundation holes, such that when the said flexible end panel is placed on the said foundation, and holes of the said flexible end panel and the said foundation are aligned, the said foundation insulating panel rests on the ground with the exterior side up, and is secured to the said building by the placement of said concrete blocks and said block assembly rods.

16. The building system of claim 12, further comprising a plurality of side insulating panels that may be placed on either the inside or the outside of the building, each said side insulating panel being sized to a standard wall height and comprising: a layer of insulation material inside a vapor barrier; one panel side finished to serve as an exterior side; and a thin, flexible end panel at each of the top and bottom ends of the said side insulating panel, each said end panel having one or more holes sized and placed to align with said vertical foundation holes, such that when a first said flexible end panel is placed on the said foundation, and holes of the said first flexible end panel and the said foundation are aligned, and a second said flexible end panel is aligned with vertical block assembly holes on the top concrete block of a said concrete block column placed on the said first flexible end panel, and said block assembly rods are in place, the said side insulating panel is secured to the side of the said building.

17. The building system of claim 12, further comprising a set of flat wall top plates placed on the top concrete blocks of a second set of parallel walls perpendicular to the said first set of parallel walls having sloped wall top plates, said flat wall top plates having holes such that the said block assembly rods run through the said flat wall top plates, and each said flat wall top plate having one or more threaded bolt structures at a standardized location on the said top plate.

18. The building system of claim 17, further comprising a steel inside perimeter structure comprising sections of steel angle iron running along the inner perimeter of the said building walls, adjacent sections of said steel angle iron being joined, and said sections of steel angle iron being joined to the said flat top plate and sloped top plate structures, so as to form top plate sections and inner perimeter angle iron sections into one perimeter structure.

19. The building system of claim 12, further comprising a set of standardized lengths of roof modules and a set of standardized lengths of sloped wall top plates, such that designs for specific buildings of the present invention having floor plans comprising one or more adjoining rectangular areas of a range of rectangle lengths and rectangle widths can be prepared to fit a specific building of the present invention to adjoin pre-existing structures of a wide variety of shapes and sizes.

20. The building system of claim 19, further comprising a system of engineering specifications such that for one or more sets of modular structural elements, any combination of the said structural elements wherein each element is within a pre-determined range of specifications as to length, spacing, and the like, will be pre-determined to meet an acceptable engineering standard for a building of the present invention.

21. A building system, comprising:

a. A foundation of poured, leveled concrete, said foundation having vertical foundation holes spaced at regular intervals, and b. A plurality of wall blocks, each said block having standardized dimensions, each said wall block having one or more wall block vertical block assembly holes at a standardized location(s) on the top of the said wall block, and each said vertical block assembly hole running entirely through the said wall block, and c. A plurality of block assembly rods and/or columns, each said block assembly rod or column comprising a first end sized to fit in said vertical foundation holes, a second end, a central rod or column section of standardized dimensions, and a length sized with respect to a standard wall height, and d. Said foundation, said regular intervals of vertical foundation hole locations, said wall blocks, said wall block vertical block assembly holes, and said block assembly rods and/or block assembly columns, being such that when the said wall blocks are in wall block columns of a standardized height on the said foundation, with for each said wall block column one or more of the said block assembly holes of each said wall block in the said wall block column being aligned with one of the said regularly spaced vertical foundation holes, said block assembly rods and/or block assembly columns are inserted through the said vertical block assembly holes in the said wall block columns so that the said first end of each said block assembly rod and/or each said block assembly column is in a said vertical foundation hole, the said second end of each block assembly rod and/or block assembly column is above the level of the top wall block of the said wall block column, and each said wall block column directly adjoins an adjacent wall block column, and e. A set of sloped wall top plates on a first set of parallel walls, each said sloped wall top plate having a flat base with holes such that said block assembly rods and/or block assembly columns run through the said sloped wall top plate base, and each said sloped wall top plate having one or more mounting angle irons attached to the said sloped wall top plate, said mounting angle irons delineating the said sloped wall top plate into sections, and each said mounting angle iron having one or more holes of a standardized size and location, and f. A framing structure, comprising one or more spanning angle iron sections, each end of each said spanning angle iron section being bolted to one of a facing pair of mounting angle irons on one of two parallel sloped top plates, and each said spanning angle iron having roof bolting holes spaced at standardized intervals, and g. Said framing structure further optionally comprising one or more minor supporting pillars, each said minor supporting pillar being placed underneath, and vertically supporting, a said spanning angle iron, and h. Said framing structure further optionally comprising one or more steel I-beam major spanning beam(s), such said major spanning beam(s) having two sets of holes spaced at standardized intervals, one said set of holes being on each of the two sides of the upper flange of the said major spanning beam, and i. A plurality of roof modules, each said roof module comprising a base layer of ribbed steel roof decking with said ribs running parallel to the longer sides of the said roof module, a layer of insulation board, a top membrane layer, means for attaching the said roof modules to the said spanning angle irons, and a set of holes on each of the shorter sides of the said roof modules such that each shorter side of the said roof module can either be bolted to one or more said block assembly rods and/or block assembly columns, or bolted to a side of the upper flange of a said optional major spanning beam.

22. A building wall structure, comprised of a. A plurality of building blocks of concrete, or a combination of concrete and insulating material, each said building block having a standardized location for one or more vertical block assembly means holes running entirely through the building block, and b. A foundation of poured, leveled concrete, having vertical foundation assembly means holes spaced at regular intervals corresponding to the vertical block assembly means holes of the said building blocks, and c. One or more block assembly rods and/or columns, each said rod or column having a first end dimensioned to be placed in a vertical foundation assembly means hole, and each said rod or column being sized to a standardized wall height, and each said rod or column central shaft section being sized to the dimensions of said vertical block assembly means holes, and d. The said building blocks, vertical foundation assembly means holes, vertical block assembly means holes, and block assembly rods and/or columns being such that when a block column of one or more building blocks is placed on a section of foundation with respective vertical foundation assembly means holes and vertical block assembly means holes aligned, one or more of the said block assembly rod or block assembly column runs through the said block column so that the said first end of the said block assembly rod and/or block assembly column rests in the foundation assembly means hole.

23. The building wall structure of claim 22 further comprising the use of building blocks of dimensions 7⅝"×7⅝"×15⅝".

24. The building wall structure of claim 22 further comprising the use of building blocks of dimensions 7⅝"×7⅝"×18".

* * * * *